US005416568A

United States Patent [19]

Yoshiki et al.

[11] Patent Number: 5,416,568

[45] Date of Patent: May 16, 1995

[54] DEVELOPING UNIT FOR AN IMAGE FORMING APPARATUS

[75] Inventors: Shigeru Yoshiki, Kawasaki; Seiji Oka; Tomoji Ishikawa, both of Yokohama; Tsukuru Kai, Fujisawa, all of Japan

[73] Assignee: Ricoh Company, Ltd., Tokyo, Japan

[21] Appl. No.: 77,749

[22] Filed: Jun. 17, 1993

Related U.S. Application Data

[63] Continuation-in-part of Ser. No. 911,078, Jul. 9, 1992, abandoned.

[30] Foreign Application Priority Data

| | | | |
|---|---|---|---|
| Jul. 9, 1991 | [JP] | Japan | 3-195901 |
| Jul. 9, 1991 | [JP] | Japan | 3-195902 |
| Jul. 9, 1991 | [JP] | Japan | 3-195903 |
| Aug. 31, 1991 | [JP] | Japan | 3-247024 |
| Jun. 17, 1992 | [JP] | Japan | 4-184486 |
| Jun. 17, 1992 | [JP] | Japan | 4-184487 |
| Jun. 18, 1992 | [JP] | Japan | 4-186311 |
| Jun. 18, 1992 | [JP] | Japan | 4-186314 |

[51] Int. Cl.[6] ..... G03G 15/06

[52] U.S. Cl. ..... 355/261; 118/647; 118/648; 118/649; 347/140; 347/158; 355/245; 355/246; 355/262; 355/265

[58] Field of Search ..... 355/245-246, 355/259, 261-263, 265, 326 R, 298; 118/647, 649, 651, 648; 346/153.1, 154, 157, 160.1

[56] References Cited

U.S. PATENT DOCUMENTS

| | | | |
|---|---|---|---|
| 4,054,885 | 10/1977 | Rothgordt | 346/154 |
| 4,181,912 | 1/1980 | Sataka | 346/154 |
| 4,392,194 | 7/1983 | Hinz et al. | 346/154 |
| 4,423,950 | 1/1984 | Sagami | 355/298 |
| 4,527,884 | 7/1985 | Nusser | 118/647 X |
| 4,558,941 | 12/1985 | Nosaki et al. | 355/262 |
| 4,568,955 | 2/1986 | Hosoya et al. | 346/153.1 |
| 4,598,991 | 7/1986 | Hosoya et al. | 355/260 |
| 4,647,179 | 3/1987 | Schmidlin | 355/262 |
| 4,658,275 | 4/1987 | Fujii et al. | 346/154 |
| 4,733,256 | 3/1988 | Salmon | 346/157 |
| 4,780,733 | 10/1988 | Schmidlin | 346/160.1 |
| 4,876,561 | 10/1989 | Schmidlin | 346/153.1 X |
| 4,912,489 | 3/1990 | Schmidlin | 346/160.1 X |
| 4,994,859 | 2/1991 | Mizuno et al. | 355/247 |
| 5,030,976 | 7/1991 | Salmon | 346/157 |
| 5,153,617 | 10/1992 | Salmon | 346/154 |
| 5,187,529 | 2/1993 | Nakayama | 355/296 |
| 5,212,522 | 5/1993 | Knapp | 355/208 |
| 5,214,477 | 5/1993 | Hirobe et al. | 355/246 |
| 5,300,339 | 4/1984 | Hays et al. | 355/259 X |
| 5,323,214 | 6/1994 | Kai | 355/245 |
| 5,325,120 | 6/1994 | Kuehnle | 346/157 |

*Primary Examiner*—Matthew S. Smith

*Attorney, Agent, or Firm*—Oblon, Spivak, McClelland, Maier & Neustadt

[57] ABSTRACT

A developing unit incorporated in an image forming apparatus and capable of transporting a developer or a toner deposited on a developing roller in a predetermined direction without rotating the developing roller, or developer carrier. The developing roller has an unrotatable base roller, a stationary body provided on the base roller and made of an insulating material, and a plurality of drive electrodes buried in the stationary body. The drive electrodes are divided into three electrode groups. Voltages whose polarities change at predetermined intervals are applied to the three electrode groups, causing the toner to be transported by the coaction of the charge of the toner and the charges of the drive electrodes. The drive electrodes are arranged at a pitch which is substantially one-third of the particle size of the toner, so that the toner may be deposited on the developing roller substantially without any clearance. To enhance repulsion acting on the toner and, therefore, efficient development, higher voltages are applied to part of the drive electrodes located in a developing region than part of the drive electrodes located in a transporting region. Such voltages may be replaced with voltages on which alternating voltages are superposed.

25 Claims, 24 Drawing Sheets

P/P IMAGE DEVELOPMENT

N/P IMAGE DEVELOPMENT

TONER TRANSPORT

+TONER TRANSPORT

-TONER TRANSPORT

TONER TRANSPORT

DEVELOPMENT

DEVELOPING UNIT FOR AN IMAGE FORMING APPARATUS

CROSS REFERENCE TO RELATED APPLICATION

This application is a continuation-in-part of U.S. application Ser. No. 07/911,078, filed Jul. 9, 1992 now abandoned.

BACKGROUND OF THE INVENTION

The present invention relates to a copier, facsimile transceiver, laser printer or similar image forming apparatus having an image carrier and, more particularly, to a developing unit incoporated in such an apparatus for developing a latent image electrostatically formed on the image carrier by a developer or a toner deposited on a developer carrier.

A developing apparatus of the type described includes a toner hopper storing a developer or a toner. The developer or the toner is agitated by, for example, an agitator, charged by a charging roller, and then deposited on the surface of a developer carrier implemented as a developing roller. The developing roller is rotated to transport the developer or the toner to a developing region where it faces the surface of a photoconductive element, or image carrier, while a blade or similar regulating member regulates the thickness of the toner on the developing roller. On reaching the developing region, the developer or the toner develops an electrostatic latent image formed on the photoconductive element to convert it to a toner image. After image transfer, the developer or the toner remaining on the photoconductive element is collected in the toner hopper as the developing roller rotates.

The above-described construction has a problem that while the developing roller is in rotation, the toner enters the gap between the roller and each side wall of the developing unit. This part of the toner rubs against and sticks fast to the developing roller and side walls to obstruct the rotation of the roller, resulting in defective images. In the case of a developing roller implemented as a developing sleeve (mainly made of aluminum) having a magnet roller thereinside, the sleeve traverses the magnetic fields of the magnet roller to generate eddy currents and thereby increases the rotation torque of the roller or heats the roller. The heat causes the toner stored in the developing unit to melt and form masses. The toner is apt to drop from axially opposite ends of the developing roller onto a paper or similar recording medium, degrading image quality. The fact that the developing roller needs drive means and has to have a cylindrical configuration critically limits the layout of the developing unit. Moreover, when the blade for regulating the thickness of toner is held in contact with the developing roller, a desirably thin toner layer and, therefore, attractive images are not achievable unless the blade is positioned with high accuracy. Especially, the blade easily wears and has to be replaced at a predetermined interval. In addition, the toner is apt to stick fast at a position where the blade and developing roller contact, also degrading the image quality.

On the other hand, a bicolor, tricolor, full color or similar multicolor copier is provided with a plurality of developing units each accommodating a toner of particular color. Each of the developing units is moved from an inoperative position remote from a photoconductive element to an operative position close thereto only at the time of development. This is to prevent the different colors from being mixed on a paper. This kind of scheme, however, needs a mechanism for moving the developing units toward and away from the photoconductive element, resulting in a complicated construction. Further, it is difficult to maintain the gap between a developing roller received in each developing unit and the photoconductive element at a developing position with relatively high accuracy.

In an image forming apparatus of the type having a removable developing unit, it is likely that a toner remaining on part of the surface of a developing roller exposed to the outside of the developing unit is scattered around when the developing unit is pulled out of the apparatus.

SUMMARY OF THE INVENTION

It is therefore an object of the present invention to provide a developing unit incorporated in an image forming apparatus and capable of transporting a developer or a toner deposited on a developing roller in a predetermined direction without rotating the roller, or developer carrier.

It is another object of the present invention to provide a developing unit for an image forming apparatus and capable of conveying a toner removed from a developing transversely within the unit while agitating it.

A developing unit incorporated in an image forming apparatus for developing an electrostatic latent image formed on an image carrier by supplying a developer from a developer carrier of the present invention comprises a developer supply member for supplying the developer carrier, and an electrostatic actuator serving as developer transporting means for transporting the developer supplied by developer supply member in a predetermined direction on and along the developer carrier.

BRIEF DESCRIPTION OF THE DRAWINGS

The above and other objects, features and advantages of the present invention will become more apparent from the following detailed description taken with the accompanying drawings in which.

DESECRATION OF THE PREFERRED EMBODIMENTS

Figure 1:
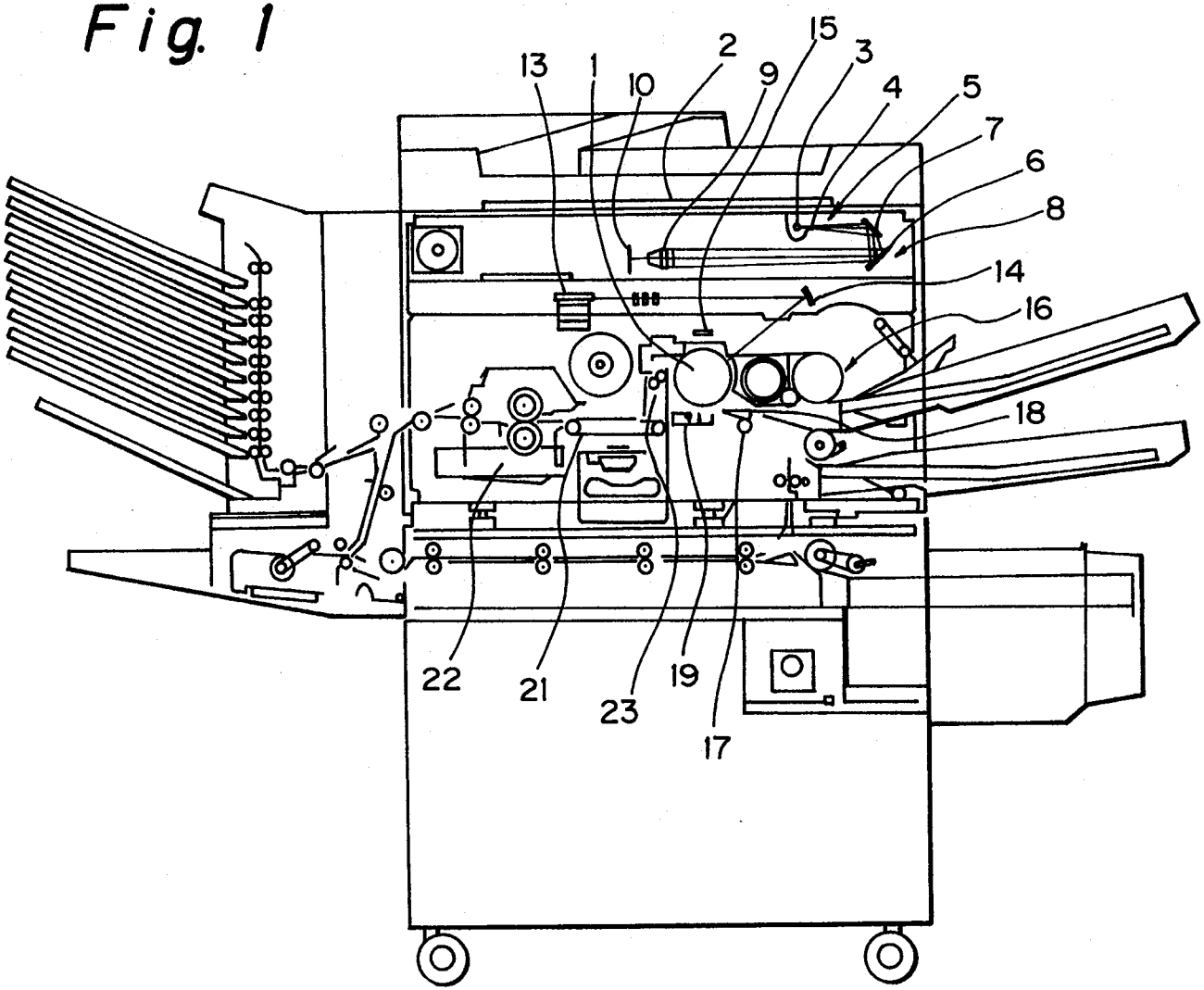
FIG. 1 is a section of an image forming apparatus to which the present invention is applicable.

Referring to FIG. 1 of the drawings, an image forming apparatus with which the present invention is practicable is shown. As shown, the image forming apparatus has an image carrier implemented as a photoconductive drum 1 (e.g. organic photoconductor or OPC) and rotatable clockwise as viewed in the figure. A document to be reproduced is laid on a glass platen 2. As the operator presses a print switch, not shown, optics 5 made up of a light source 3 and a mirror 4 and optics 8 constituted by mirrors 6 and 7 are moved to scan the document laid on the glass platen 2. The resulting reflection from the document is incident to an image sensor 10 located at the rear of the lens 9. In response, the image sensor 10 generates an image signal representative of the document image. The image signal is digitized and then processed. The processed signal drives a laser diode (LD). A laser beam from the LD is reflected by a polygonal mirror 13 and then steered by a mirror 14 to scan the drum 1 which is uniformly charged by a main charger 15 beforehand. As a result, the laser beam electrostatically forms a latent image on the surface of the drum 1. A developing unit 16 in accordance with the present invention develops the latent image by a toner to produce a toner image. The toner image is transferred from the drum 1 to a paper sheet or similar recording medium fed from a paper feed section 17 by the corona discharge of a transfer charger 18. The paper sheet with the toner image is separated from the surface of the drum 1 by a separation charger 19 and then transported to a fixing roller pair 22 by a transport belt 21. After the toner image has been fixed on the paper sheet by the roller pair 22, the paper sheet is driven out of the apparatus. After the image transfer, the toner remaining on the surface of the drum 1 is removed by a cleaning unit 23.

Preferred embodiments of the developing unit 16 in accordance with the present invention will be described hereinafter.

1st EMBODIMENT

Figure 2:
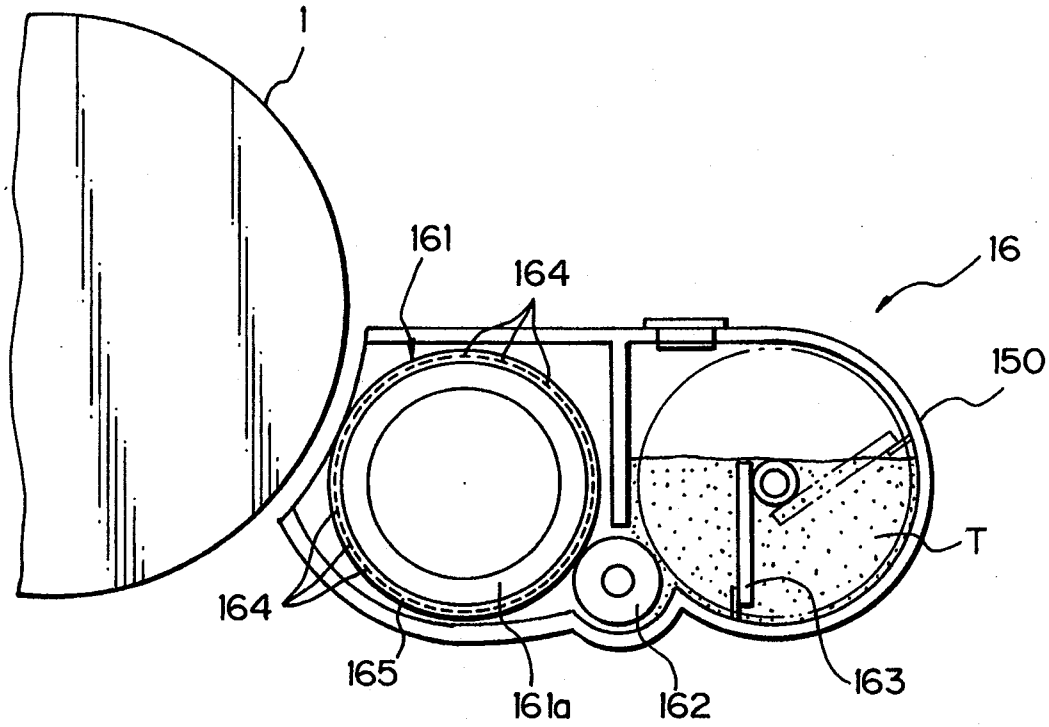
FIG. 2 is a section showing a first embodiment of the developing unit in accordance with the present invention.

As shown in FIG. 2, a first embodiment of the developing unit 16 has toner transporting means in the form of a developing roller 161, a charging roller or toner supply roller 162 for frictionally charging a toner T to predetermined polarity in contact with the surface of the developing roller 161, and an agitator 163 for conveying the toner T existing in a toner hopper 150 to the neighborhood of the charging roller 162. Specifically, the toner T in the toner hopper 150 is conveyed by the agitator 163 to the charging roller 162, charged to predetermined polarity by the roller 162, and then driven to the surface of the developing roller 161. The toner T deposited on the surface of the developing roller 161 is transported to a developing region where the roller 161 faces the drum 1. In the developing region, the toner T is deposited on the latent image formed on the drum 1 to thereby form a corresponding toner image. Part of the toner T not transferred to the drum 1 is returned to the hopper 150 and removed from the developing roller 161 by the charging roller 162.

The developing roller 161 serving as toner transporting means is constituted by an unrotatable base roller **161*a*, and an electrostatic actuator made up of a stationary body 165 made of an insulating material and a plurality of electrodes 164** buried in the stationary body 165. The electrodes, or drive electrodes as referred to hereinafter, 164 each has a stripe configuration extending in the axial direction of the base roller 161*a*. As shown in FIGS. 3A–3F, nearby drive electrodes 164 are each connected to particular one of a first to a third electrode terminal 164*a*, 162*b* and 164*c*, whereby a first to a third electrode group are formed. The drive electrodes 164 may be arranged at a pitch of about 10–20 microns in the circumferential direction of the developing roller 161 so as to cause toner particles whose diameter is about 10 microns to deposit in a single row on a single drive electrode 164 (see FIGS. 3A–3F). Alternatively, the drive electrodes may be provided with a greater width and a greater pitch in the above-mentioned direction to cause the toner particles to deposit in a plurality of rows on a single drive electrode. When voltages are applied to the electrode terminals 164*a*–164*c* from a power source unit, not shown, the charge of the toner T and the charges of the stationary body 165 coact to generate forces for transporting the toner T, as will be described later specifically. Control circuitry, not shown, includes a CPU (Central Processing Unit) and causes the power source unit to apply voltages to the electrode terminals 164*a*–164*c* in either of two different ways which will cause the toner T to move in opposite directions on the developing roller 161.

Assume that a black toner Tb is accommodated in the toner hopper 150 and frictionally charged to positive polarity (+) by the charging roller 162 by way of example. The toner Tb has to have a predetermined resistance, as will be described. Specifically, use may be made of a conventional single component type developer, i.e., a toner made up of a resin and a charge control agent added thereto and having a resistance sufficient to hold a frictional charge. When the toner hopper 150 runs out of the toner Tb, such a condition is detected in terms of the rotation torque of the agitator 163. Specifically, when the rotation torque of the agitator 163 becomes smaller than predetermined one, it is determined that the toner hopper 150 has run out of the toner Tb. Then, a toner end indicator provided on an operation panel, not shown, is turned on to inform the operator of the toner end condition.

How the developing unit 16, i.e., the developing roller 161 with the electrostatic actuator transports the toner Tb on the actuator in a predetermined direction, e.g., to the right as viewed in FIG. 3A–3F is as follows.

Figure 3A:
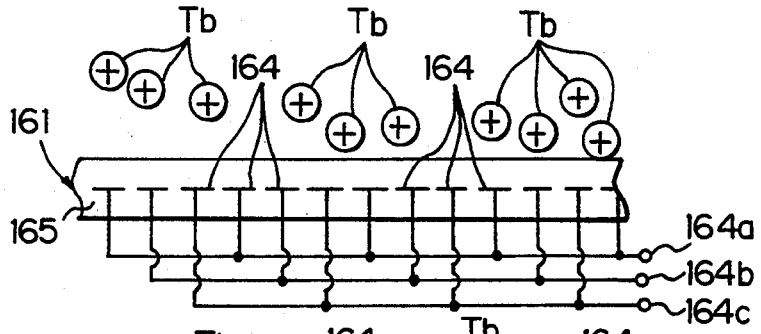
FIGS. 3A–3F show the principle of toner transport particular to the first embodiment.
Figure 3B:
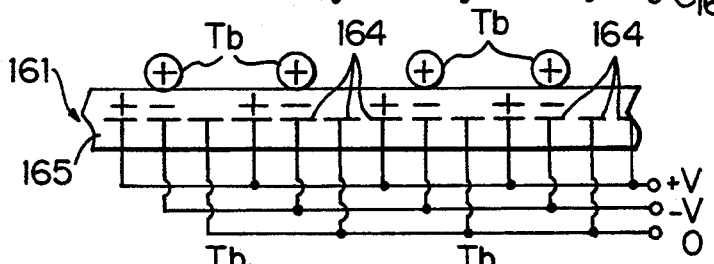

As shown in FIG. 3A, when no voltages are applied to the electrode terminals 164*a*–164*c*, charge does not exist on any of the first to third electrode groups. Although the toner Tb, which is indicated by circles, is frictionally charged to positive polarity by the charging roller 162, it is not effected by the drive electrodes 164 at all and, therefore, not transported since the stationary body 165 is not charged. In this condition, the toner Tb floats around the developing roller 161 or deposits on the stationary body 165 due to some force which may act thereon. As shown in FIG. 3B, a positive voltage +V, a negative voltage −V and 0 V are applied to the first, second and third electrode terminals 164*a*, 164*b* and 164*c*, respectively. Then, the toner Tb is attracted by the drive electrodes 164 constituting the second electrode group and opposite in polarity to the toner Tb, i.e., the positively charged toner Tb is caused to deposit on part of the surface of the developing roller or actuator where the drive electrodes 164 applied with −V are positioned. Meanwhile, the toner Tb is not attracted by the drive electrodes 164 constituting the first and second electrode groups.

Figure 3C:
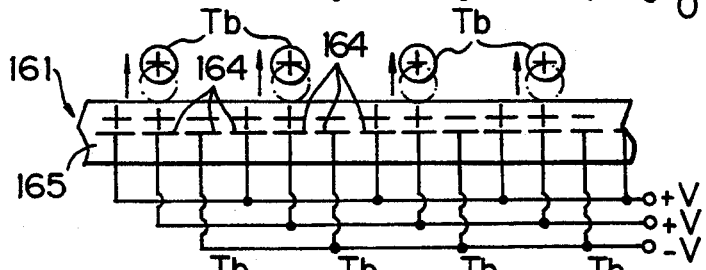
Figure 3D:
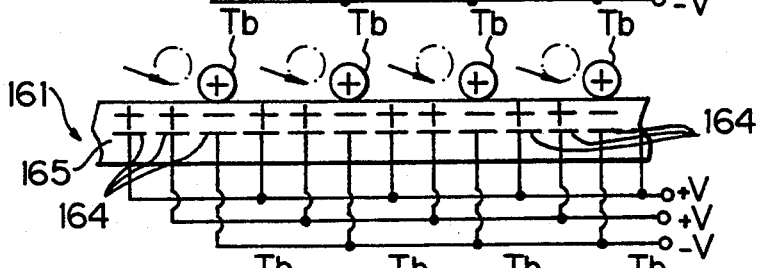

Subsequently, as shown in FIG. 3C, +V which is the same in polarity as the toner Tb is applied to the second group of drive electrodes 164 just underlying the toner Tb. At the same time, −V opposite in polarity to the toner Tb is applied to the third group of drive electrodes 164 next to the second group of drive electrodes 164 in the toner transport direction (at the right-hand side in the embodiment). Further, +V is applied to the first group of drive electrodes 164 located at the left-hand side of the second group of drive electrodes 164. As a result, a repulsion acts between the toner Tb and the drive electrodes 164 underlying the toner Tb and of the same polarity as the toner Tb, causing the toner Tb to float. As shown in FIG. 3D, the drive electrodes 164 constituting the third electrode group attract the toner Tb floating at the upper left side thereof since the former is opposite in polarity to the latter. Further, the drive electrodes 164 constituting the first electrode group repulse the toner Tb floating at the upper right side thereof since the former is of the same polarity as the latter Tb. As a result, a driving force acts on the toner Tb rightward and causes it to move about one pitch of the drive electrodes 164.

Figure 3E:
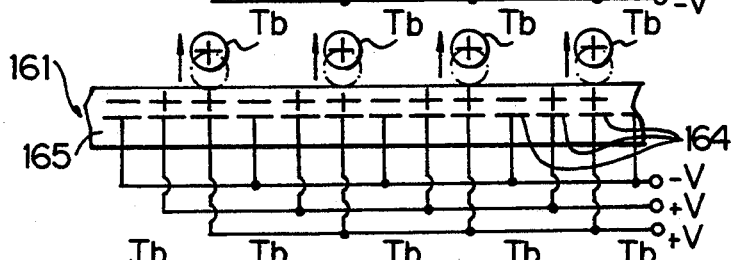
Figure 3F:
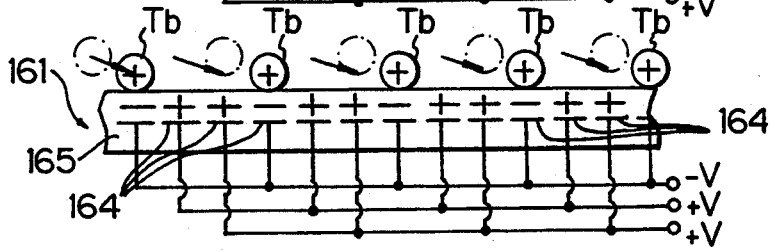

At this instance, the friction between the toner Tb and the roller surface is reduced by the force causing the toner to float. Thereupon, as shown in FIGS. 3E and 3F, the voltages applied to the drive electrodes 164 are switched over to shift such a repulsion and drive pattern acting on the toner Tb. By the above procedure, the toner Tb is transported along the roller surface, about one pitch at a time.

The procedure shown in FIGS. 3B–3F and the subsequent switchover of the voltages to the drive electrode groups are listed in Table 1 below.

TABLE 1

| ELECTRODE GROUP | I | → | II | → | III | → | IV | → | ONWARD |
|---|---|---|---|---|---|---|---|---|---|
| 1ST GROUP | +V | → | +V | → | −V | → | +V | → | REPEAT II~IV |
| 2ND GROUP | −V | → | +V | → | +V | → | −V | → | REPEAT II~IV |
| 3RD GROUP | O | → | −V | → | +V | → | +V | → | REPEAT II~IV |

In Table 1, a step I corresponds to FIG. 3B, a step II corresponds to FIGS. 3C and 3D, and a step III corresponds to FIGS. 3E and 3F. In a step IV, +V, −V and +V are respectively applied to the first to third electrode groups to shift the repulsion and drive pattern acting on the toner Tb one pitch to the right in the toner transport direction. Thereafter, the steps II–IV are repeated to shift such a pattern, one pitch at a time.

It is to be noted that in FIG. 3 (step II), for example, the positive voltage and the negative voltage may be respectively applied to the third group of drive electrodes 164 and the first group of drive electrodes 164 to reverse the drive direction.

In the illustrative embodiment, a toner having a high resistance or having a medium resistance may be used so long as it can be charged by friction. However, a toner of medium resistance has a problem, as follows. Assume that at the moment when the polarities of the voltages applied to the drive electrodes 164 are changed while such a toner is deposited on the surface of the developing roller or actuator above the drive electrodes 164, a charge opposite in polarity to the toner is momentarily induced below the toner by the resulting charges deposited on the electrodes 16. Then, the toner will be attracted by the above-mentioned charge and, therefore, will not be sufficiently repulsed. In the light of this, the resistance of the toner should be high enough to insure the repulsion at the time of switchover of the voltages to the drive electrodes 164.

Figure 4:
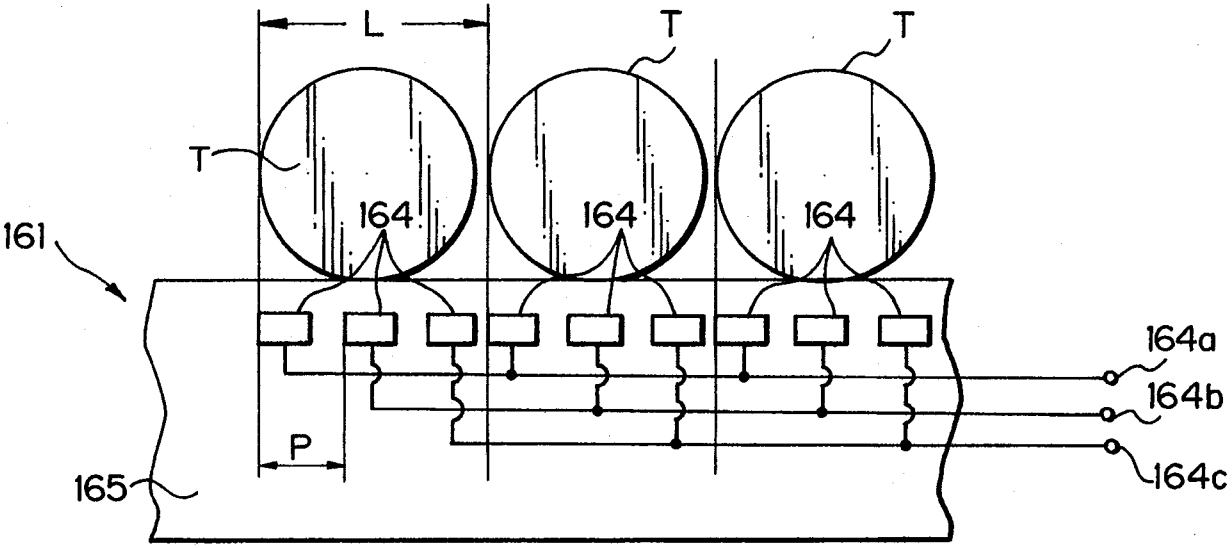
FIG. 4 shows the arrangement of drive electrodes included in the first embodiment.

As shown in FIG. 4, to cause the toner T to deposit on the surface of the developing roller or actuator 161 in as great an amount as possible, the drive electrodes 164 may be arranged at such a pitch that the width L covering the first to third groups of drive electrodes 164 as well as the distance thereof is substantially equal to the size of a single toner particle. Specifically, the drive electrodes 164 may be arranged at a pitch P which is substantially one-third of the particle size of one toner particle. Greater pitches P would space apart nearby toner particles. Smaller pitches P would prevent the toner particles from depositing densely on the surface of the developing roller 161 and cause them to float away from the roller surface, as will be understood when a single toner layer is observed. In any case, the toner would not be smoothly transported by the previously stated principle.

Further, the illustrative embodiment divides the drive electrodes 164 into a first to a third electrode group and causes the toner T to deposit on one of the three electrode groups. Hence, the toner T is deposited on the developing roller 161 over substantially each one-third of the entire circumference of the roller 161. Therefore, the toner T should preferably be moved (transported) on the developing roller 161 at a speed at least three times as high as the linear velocity of the drum 1.

As described above, this embodiment transports the toner T by the principle of an electrostatic actuator without rotating the developing roller 161. This eliminates the parts subjected to friction due to the rotation of the developing roller 161 and, therefore, the stresses which would otherwise act on the toner to cause it to stick fast. Since the developing roller 161 does not rotate, the increase in torque ascribable to eddy currents is eliminated while heat is suppressed to prevent the toner from melting.

As shown in FIG. 2, the embodiment positions the charging roller 162 below the center of the developing roller 161 in order to cause excessive part of the toner T deposited on the roller 161 to fall due to gravity. Specifically, such a toner T is let fall by gravity to leave a desirably thin toner layer on the roller 161. Should the charging roller 162 be disposed above the center of the developing roller 161, the toner T passed the charging roller 162 in a layered condition would reach the developing region in an irregular distribution on the roller 161 or accumulate between the rollers 162 and 161.

While the toner T has been shown and described as being charged by friction, it may be transported without resorting to frictional charge. Specifically, an arrangement may be made such that after a charge opposite in polarity to the drive electrodes 164 has been induced below the toner T, as shown in FIG. 3B, the voltages to the drive electrodes 164 are switched over, as shown in FIG. 3C. Then the toner is moved by a repulsion acting between the induced charge below the toner T and the drive electrodes 164. Again, the resistance of the toner T should be high enough to insure a sufficient repulsive force on the switchover of the voltages to the drive electrodes 164 for the previously stated reason.

2nd EMBODIMENT

In an alternative embodiment which will be described, the developing unit 16 stores two different kinds of toners T chargeable to opposite polarity to each other. These toner T are transported by the same principle as in the first embodiment. Specifically, in the developing region where the developing roller 161 faces the drum 1, a suitable bias voltage for development is applied to deposit each toner of particular polarity on the latent image formed on the drum 1 on the basis of the electric field generated by the latent image and the bias voltage. This embodiment is practicable with two toners of the same color or of different colors, as desired.

How the embodiment, i.e., the developing roller or electrostatic actuator 161 transports the toner T in a predetermined direction, e.g., to the right as viewed in FIGS. 5A–5F will be described.

Figure 5A:
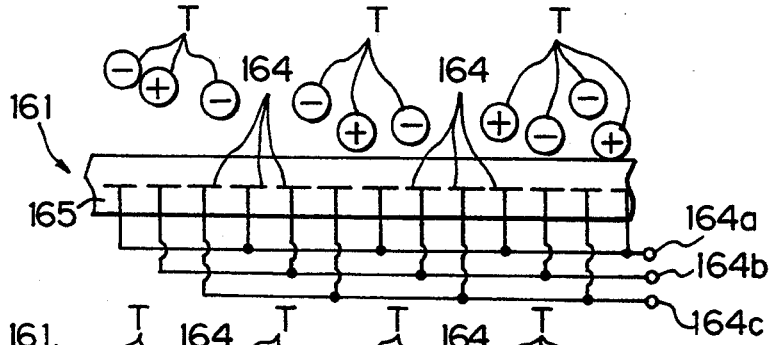
FIGS. 5A–5F show the principle of toner transport particular to a second embodiment of the invention.
Figure 5B:
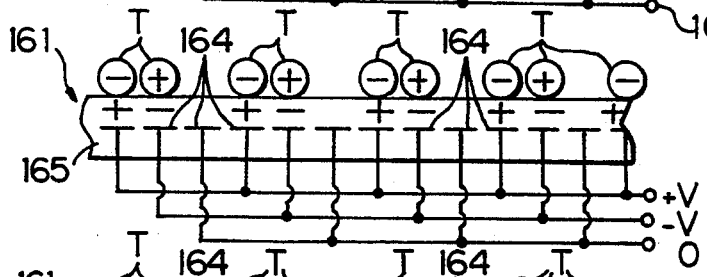

As shown in FIG. 5A, when a voltage is not applied to any of the electrode terminals **164*a*–164*c*, charge does not exist on any of the first to third electrode groups. Although the toner T, which is indicated by circles, is frictionally charged to positive polarity or negative polarity by the charging roller 162, it is not effected by the drive electrodes 164 at all and, therefore, not transported since the stationary body 165 is not charged. In this condition, the toner T floats around the developing roller 161 or deposits on the stationary body 165 due to some force which may act thereon. As shown in FIG. 5B, a positive voltage +V, a negative voltage −V and 0 V are applied to the first, second and third electrode terminals 164*a*, 164*b* and 164*c*, respectively. Then, the toner T is attracted by the drive electrodes 164 opposite in polarity to the toner T. Specifically, the negatively charged toner T is deposited on the roller surface above the electrodes 164 to which +V is applied, or the positively charged toner T is deposited on the roller surface above the electrodes to which −V is applied. Meanwhile, the toner T is not attracted by the drive electrodes 164** to which no voltages are applied.

Figure 5C:
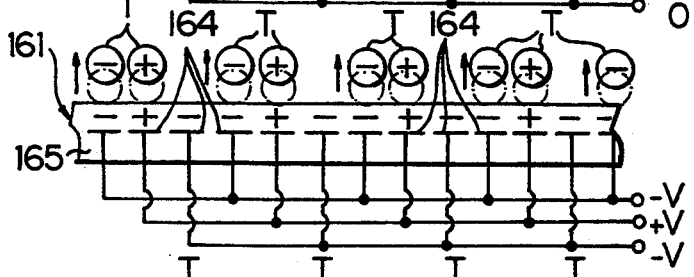
Figure 5D:
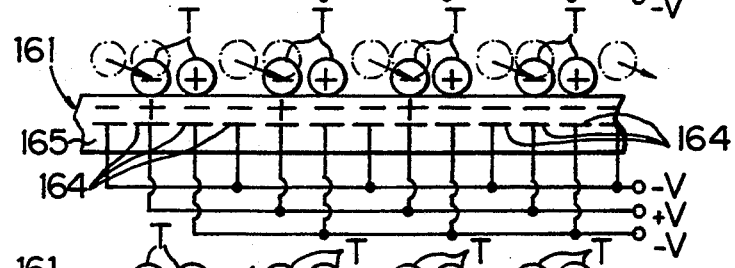
Figure 5E:
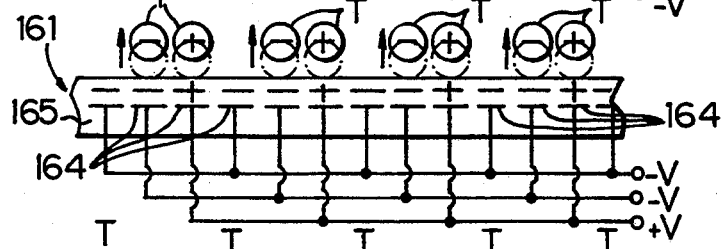
Figure 5F:
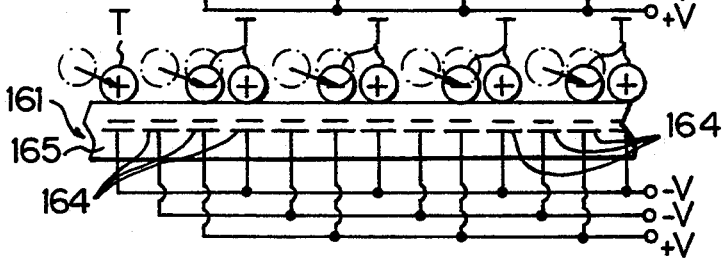
Figure 6:
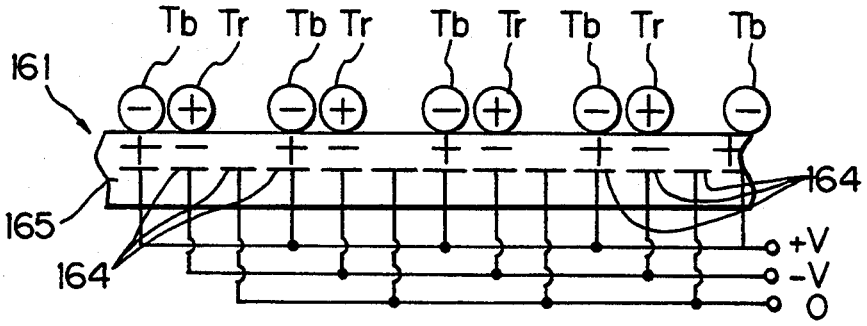
FIGS. 6 and 7 demonstrate how the second embodiment transports a toner.

Subsequently, the voltages are switched over, as shown in FIG. 5C (i.e., −V, +V and −V are respectively applied to the first to third groups of drive electrodes 164). As a result, a repulsion acts between the toner T and the drive electrodes 164 just underlying the toner T and of the same polarity as the toner T, causing the toner T to float. As shown in FIG. 5D, the charge of the drive electrodes 164 constituting the third electrode group repulses the toner T disposed at the upper right side thereof and attracts the toner T disposed at the upper left side. Consequently, a driving force acts on the toner T rightward and causes it to move about one pitch of the drive electrodes 164. At this instance, the friction between the toner T and the roller surface is reduced by the force causing the toner to float. Thereupon, as shown in FIGS. 5E and 5F, the voltages applied to the drive electrodes 164 are switched over to shift such a repulsion and drive pattern acting on the toner T. By the above procedure, the toner T is transported along the roller surface, about one pitch at a time.

The procedure shown in FIGS. 5B–5F and the subsequent switchover of the voltages to the drive electrode groups are listed in Table 2 below.

TABLE 2

| ELECTRODE GROUP | I | → | II | → | III | → | IV | → | ONWARD |
|---|---|---|---|---|---|---|---|---|---|
| 1ST GROUP | +V | → | −V | → | −V | → | +V | → | REPEAT II~IV |
| 2ND GROUP | −V | → | +V | → | −V | → | −V | → | REPEAT II~IV |
| 3RD GROUP | O | → | −V | → | +V | → | −V | → | REPEAT II~IV |

In Table 1, a step I corresponds to FIG. 5B, a step II corresponds to FIGS. 5C and 5D, and a step III corresponds to FIGS. 5E and 5F. In a step IV, +V, −V and −V are respectively applied to the first to third drive electrode groups to shift the repulsion and drive pattern acting on the toner Tb one pitch to the right in the toner transport direction. Thereafter, the steps II–IV are repeated to sequentially shift such a pattern, one pitch at a time.

It is to be noted that in FIG. 5C (step II), for example, the positive voltage may be applied to the third group of drive electrodes 164 to reverse the drive direction.

With the electrostatic actuator principle described above, it is possible to develop a latent image formed on the drum 1 by the developing unit 16 accommodating two different kinds of toners therein which are opposite in polarity to each other, as follows.

Assume that the developing unit 16 stores a negatively chargeable black toner Tb and a positively chargeable red toner Tr for forming a bicolor image on the drum 1. Then, the image forming apparatus shown in FIG. 1, for example, is so constructed as to separate the image signal generated by the image sensor 10 into a black image component and a red image component. First, a positive (P/P) latent image representative of a black image is formed on the drum I having been charged to positive polarity by the main charger 15. As the P/P latent image is brought to the developing region, it is developed by the negatively charged black toner Tb transported along the surface of the roller 161, i.e., the surface of the electrostatic actuator together with the toner Tr under a suitable bias voltage. While the resulting black toner image sequentially passes the transfer charger 18, separation charger 19 and cleaning unit 23 due to the rotation of the drum 1, the chargers 18 and 19 and cleaning unit 23 are held inoperable. At the same time, the drum 1 is again sequentially charged to positive polarity from the area thereof reached the main charger 15. Then, a negative (N/P) latent image representative of a red image is formed on the drum 1. The N/P image brought to the developing region is developed by the positively charged red toner Tr transported along the surface of the electrostatic actuator together with the black toner Tb under a suitable bias voltage (reversal development). As a result, a red toner image is formed on the drum 1 over the black toner image. The composite bicolor image is transferred to a paper or similar recording medium fed from the paper feed section 17 by the transfer charger 17. Then, the paper is separated from the surface of the drum 1 by the separation charger 19, transported to the fixing roller pair 22 by the transport belt 21, and then driven out of the apparatus as a bicolor copy. After the image transfer, the toner particles remaining on the drum 1 are removed by the cleaning unit 23.

The plurality of drive electrodes 164 are divided into the first to third electrode groups. The black toner Tb is attracted by one of the three electrode groups, the red toner is attracted by another electrode group, and no toner T is deposited on the remaining electrode group. Stated another way, the black toner Tb is present in substantially one-third of the entire circumference of the developing roller 161, the red toner is present in another one-third, and no toner T is present in the remaining one-third. It follows that the toner T is moved (transported) along the developing roller 161, i.e., the electrostatic actuator at a speed three times as high as the linear velocity of the drum 1, so that the black toner Tb and red toner Tr may be supplied to desired part of the drum 1. While the embodiment forms a latent image representative of a black image and a latent image representative of a red image independently and develops each of them, a composite photoconductive element for conventional bicolor image formation may be used to form such latent images at the same time and develop them at the same time.

The embodiment is capable of developing latent images formed on the drum 1 by two kinds of toners of the same color and opposite in polarity to each other, e.g., black toners, as follows.

Figure 7:
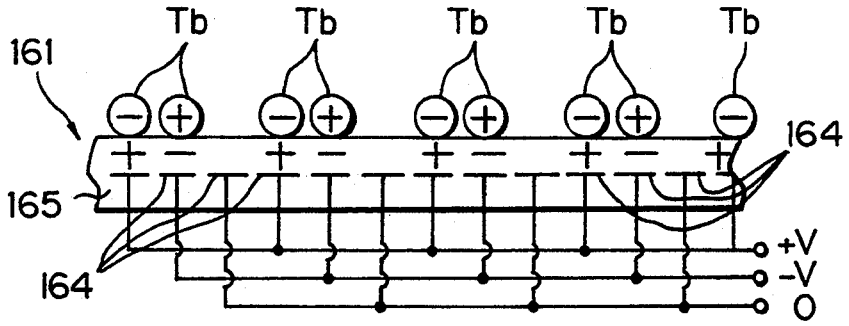

First, latent images to be developed by the respective toners T are formed on the drum 1 having been charged to predetermined polarity by the main charger 15. As each of the latent images is moved to the developing region, the toner Tb of particular polarity transported along the surface of the developing roller or electrostatic actuator is supplied to the latent image under a suitable bias voltage due to the coaction of the latent image and bias voltage, as shown in FIG. 7. In this case, the black toner Tb is present in substantially two-thirds of the entire circumference of the developing roller 161, and no toner Tb is present in one-third. Hence, the toner is moved (transported) along the developing roller 161 at a speed at least one and half times as high as the linear velocity of the drum 1, so that the black toner Tb may be supplied to any desired part of the drum 1.

3rd. EMBODIMENT

Figure 8:
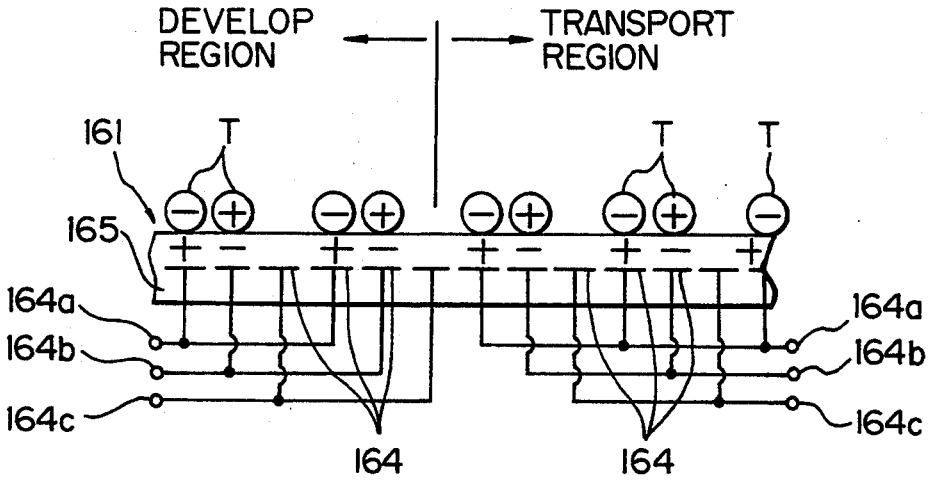
FIG. 8 shows a developing roller representative of a third embodiment of the present invention.

This embodiment is identical with the construction shown in FIG. 2 and has the developing roller 161 configured in the same manner as in the first and second embodiments. Specifically, the electrostatic actuator constituting the developing roller 161 is made up of the stationary body 165 provided on the base roller **161*a*, and the drive electrodes 164 buried in the stationary body 165 and forming the first to third electrode groups. The difference is that, as shown in FIG. 8, the drive electrodes 164 located in the developing region and the drive electrodes 164 located in the transporting region are connected to respective first to third electrode terminals 164*a*–164*c* independently of each other. The transport principle using the electrostatic actuator and described with reference to FIGS. 5A–5F and Table 2 also applies to this embodiment. The toner T is conveyed from the toner hopper 150 to the charging roller 162 by the agitator 163, charged to predetermined polarity by the roller 162, and then conveyed to the surface of the developing roller 161. As the toner T reaches the developing region, suitable voltages are applied to the drive electrodes 164 disposed in the developing region. As a result, the positively charged toner T and the negatively charged toner T are each deposited on a particular latent image formed on the drum 1 by an electric field generated by the latent image and the electric field of the drive electrodes 164. The toner T not transferred to the drum 1 is returned to the toner hopper 150 and removed by the charging roller 162**.

To enhance efficient toner transfer to the drum 1 in the developing region, this embodiment applies higher voltages to the drive electrodes 164 located in the developing region than to the electrodes 164 situated in the transporting region, as will be described hereinafter specifically.

Assume that a P/P latent image for regular development is formed on the drum 1 and then developed by the positively charged toner (on the assumption that the drum 1 is uniformly charged to positive polarity) when it passes the developing region, the drum 1 is rotated while carrying the resulting toner image thereon or after the transfer of the toner image to a paper sheet, and an N/P latent image for reversal development is formed on the drum and then developed by the negatively charged toner (here, the drum 1 is uniformly charged to negative polarity) in the developing region.

Figure 9A:
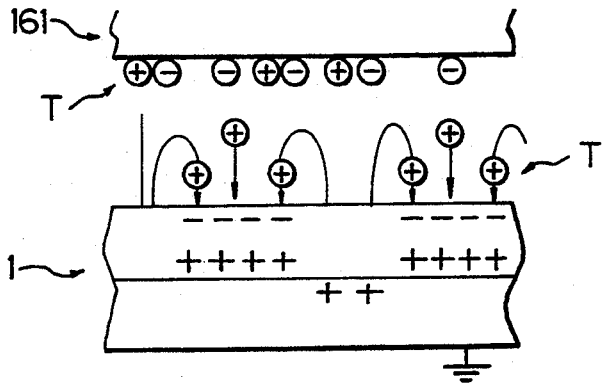
FIGS. 9A and 9B show the movement of a toner in a developing region particular to the third embodiment at the time of regular development and reversal development, respectively.
Figure 10A:
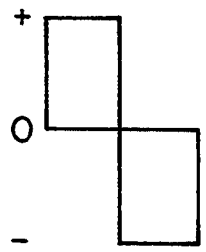
FIG. 10A show part of waveforms of voltages applied to be applied to drive electrodes in the transporting region during development in the third embodiment.
Figure 10B:
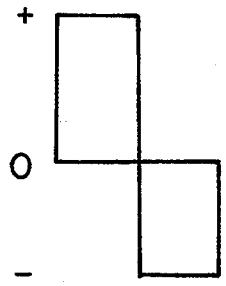
FIGS. 10B and 10C show respectively part of waveforms of voltages to be applied to drive electrodes in the developing region in the event of regular development in the third embodiment and part of waveforms to be applied thereto in the event of reversal development.
Figure 10C:
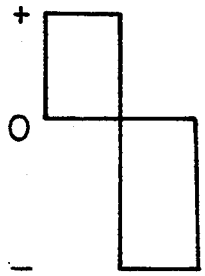

After the surface of the drum 1 has been uniformly charged to negative polarity, the charge existing on part of the drum 1 corresponding to the background is erased by a laser beam to form a P/P latent image. The P/P latent image enters the developing region, as shown in FIG. 9A specifically. As shown, the positively charged toner T is transferred from the surface of the developing roller 161 to part of the drum 1 where the negative charge is left. To promote efficient transfer of such a toner T, the embodiment applies voltages shown in FIG. 10B to the drive electrodes 164 existing in the developing region via the respective electrode terminals **164*a*–164*c*. Among the voltages shown in FIG. 10B, the positive voltage has a greater absolute value than the positive voltage shown in FIG. 10A and applied to the drive electrodes existing in the transporting region. It is to be noted that FIGS. 10A and 10B show, among the waveforms of voltages applied to the drive electrodes 164, only the part whose polarity is switched over. This is also true with FIGS. 10C and 12A–12C**.

Figure 9B:
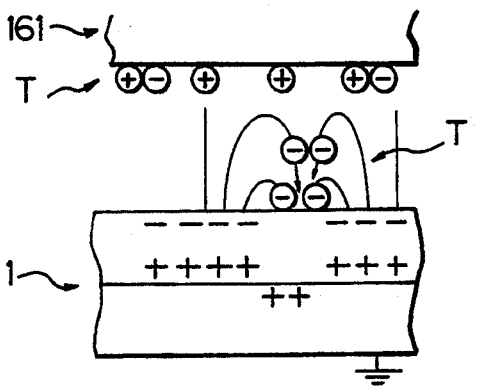

On the other hand, after the surface of the drum 1 has been uniformly charged to negative polarity, the charge existing in part thereof corresponding to characters and lines included in an image (part other than the background) is erased by a laser beam to form an N/P latent image. FIG. 9B shows a condition wherein the N/P latent image has reached the developing region specifically. As shown, the negatively charged toner T carried on the developing roller 161 is transferred to the part of the drum 1 where the negative charge has been erased. To enhance the transfer of this toner T, this embodiment applies voltages shown in FIG. 10C to the drive electrodes 164 lying in the developing region via the respective electrode terminals **164*a*–164*c*. The negative voltage shown in FIG. 10C has a greater absolute value than the negative voltage shown in FIG. 10A and applied to the drive electrodes 164** in lying the transporting region.

Figure 11:
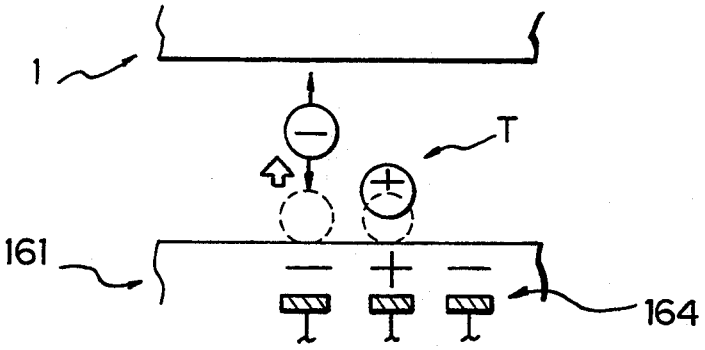
FIG. 11 shows forces acting on the toner lying in the developing region in the event of reversal development.

As stated above, a voltage of the same polarity as the toner T and having a greater absolute value is applied to the drive electrodes 164 existing in the developing region. This is successful in promoting the deposition of the toner of predetermined polarity on the drum 1. For example, assume that the negatively charged toner deposited on the developing roller 161 should be transferred to part of the N/P latent image where the negative charge has been erased. Then, as shown in FIG. 11, each of the toners T lying in the developing region floats due the a repulsion acting between it and the drive electrodes 164 of the same polarity and is moved toward the surface of the drum 1. As a result, the distance between the toner T and the drum 1 is reduced. It follows that the force F1 attracting the toner T toward the drum 1 increases and overcomes the force F2 attracting it toward the developing roller 161, causing it to deposit on the drum 1. The force F1 is expressed as:

$$Fl=q\times(\epsilon\times\Delta V)/d$$

where q is the charge deposited on the toner T, $\epsilon$ is the dielectric constant of the toner T, $\Delta V$ is the potential difference between the drum 1 and the developing roller 161, and d is the distance between the drum 1 and the toner T.

By increasing the absolute value of, among the voltages applied to the drive electrodes 164 lying in the developing region, the voltage of the same polarity as the negatively charged toner T, it is possible to intensity the repulsion to thereby cause the toner to move closer to the surface of the drum 1. As a result, the above-mentioned force F1 is intensified to enhance the deposition of the toner T on the latent image.

While the toners T of opposite polarities may be of the same color, they may alternatively be of different colors and form respective toner images on the drum 1. Then, the toner images of different colors will be superposed on the drum 1 or on a paper sheet to produce a bicolor image.

Figure 12A:
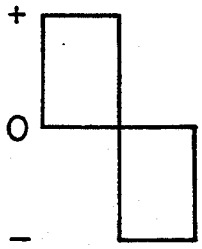
FIG. 12A shows part of waveforms of voltages to be applied to the drive electrodes located in a transporting region in the third embodiment.
Figure 12B:
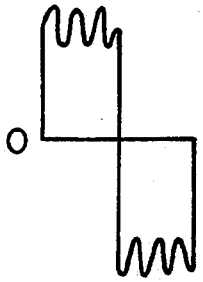
FIG. 12B shows part of waveforms of voltages to be applied to the drive electrodes in the developing region when regular development an reversal development are effected a t the same time.
Figure 12C:
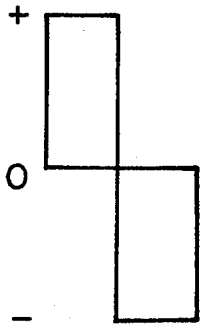
FIG. 12C shows part of waveforms to be applied to the drive electrodes in a modification.

Hereinafter will be described another specific case wherein two independent laser optics are used to form a P/P latent image and an N/P latent image on the drum 1 at the same time, and the P/P and N/P latent images are respectively developed by a positively charged toner (part corresponding to characters and lines is held at positive potential) and a negatively charged toner (part corresponding to the background is held at negative potential) at the same time. To form the P/P and N/P latent images on the drum 1 at the same time, use may be made of a conventional composite photoconductive element for bicolor development. To enhance the deposition of each of the toners on the particular latent image, the voltages shown in FIG. 12B or those shown in FIG. 12C are applied to the drive electrodes 164 disposed in the developing region. The voltages shown in FIGS. 12B and 12C are produced by superposing alternating voltages on the voltages shown in FIG. 12A and applied to the drive electrodes 164 lying in the transporting region. Specifically, in FIG. 12B, the alternating voltages shorter in switching period than the voltages for transport are superposed while, in FIG. 12C, alternating voltages equivalent in switching period as the voltages for transport are superposed. Hence, the positively charged toner and the negatively charged toner each floats due to the repulsion acting between it and the drive electrodes of the same polarity. As the force F1 tending to pull the toner toward the drum 1 overcomes the force F2 tending to pull it toward the developing roller 161, the toner is deposited on the drum 1 to develop the associated latent image. The above-mentioned superposed alternating voltages intensify the force F1 and thereby promote the deposition of the toner T on the latent image.

Again, while the toners T of opposite polarities may be of the same color, they may alternatively be of different colors and form respective toner images on the drum 1. Then, the toner images of different colors will be superposed on the drum 1 or on a paper sheet to produce a bicolor image.

As stated above the illustrative embodiment enhances development since higher voltages are applied to the drive electrodes 164 lying in the developing region than to the drive electrodes 164 lying in the transporting region to thereby intensity the force repulsing the toner T toward the drum 1.

4th EMBODIMENT

Figure 13:
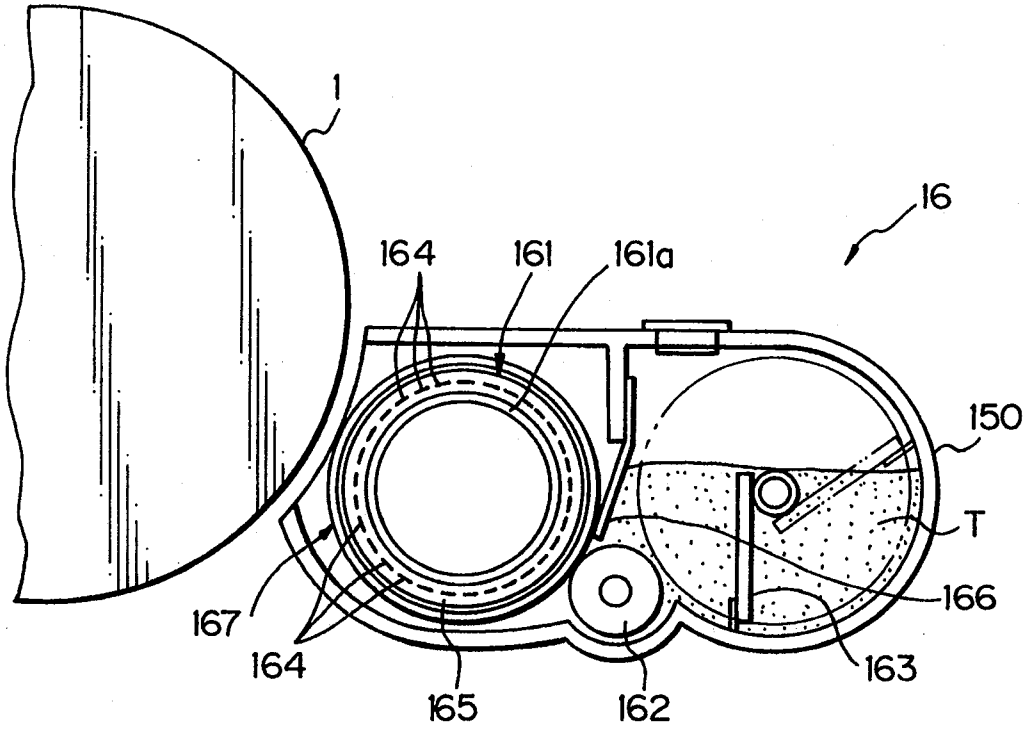
FIG. 13 is a section showing a fourth and a fifth embodiment of the invention.

As shown in FIG. 13, a fourth embodiment of the invention has toner transporting means made up of the developing roller or electrostatic actuator 161 and a rotatable developing sleeve 167 surrounding the roller 161. The developing roller 161, like the developing roller 161 of the previous embodiments, has the stationary body 165 provided on the base roller 161*a*, and the drive electrodes 164 buried in the stationary body 165. A blade 166 is located such that the edge thereof contacts the surface of the developing sleeve 167 below the center of the sleeve 167. The blade 166 charges the toner T by friction and, at the same time, forms a thin toner layer, e.g., a single toner layer on the developing sleeve 167. The charging roller 162 is held in contact with the surface of the developing sleeve 167 below the position where the blade 166 contacts the sleeve 167, thereby conveying the toner T to such a position. The discharging roller 162 may be implemented as an elastic roller capable of charging the toner T to predetermined polarity by friction. In this embodiment, use is made of a nonmagnetic one-component toner. The agitator 163 transports the toner from the toner hopper 150 to the charging roller 162.

Figure 14A:
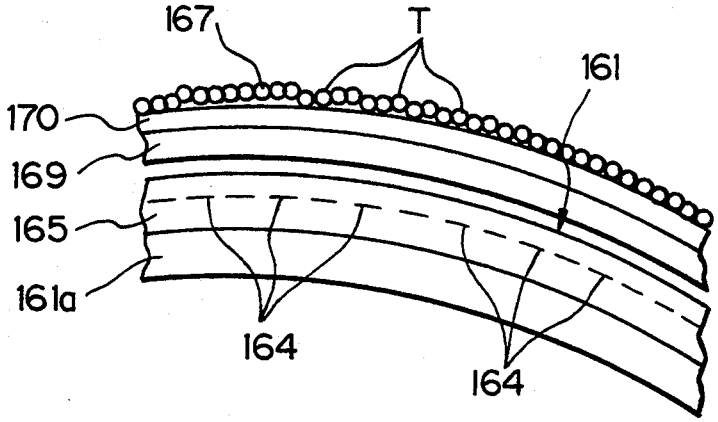
FIG. 14A is a section showing a developing sleeve and a developing roller included in each of the fourth and fifth embodiments.
Figure 14B:
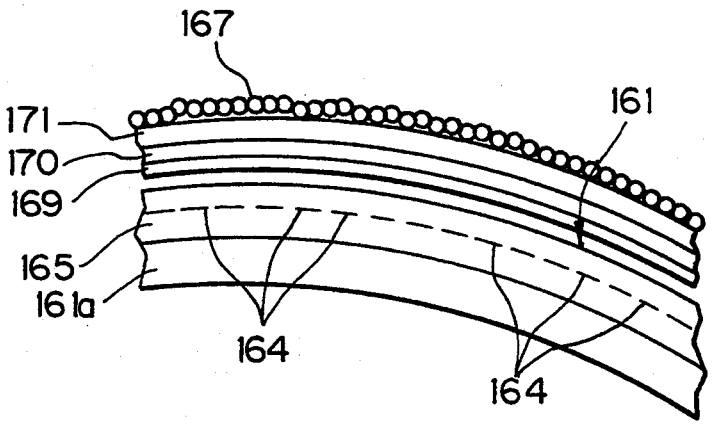
FIG. 14B is a section showing a modified form of the developing sleeve shown in FIG. 14A.
Figure 15A:
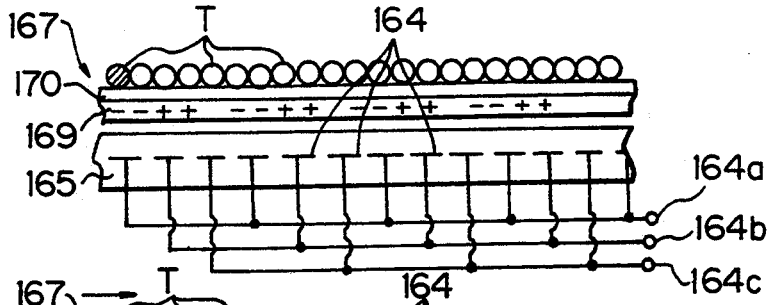
FIG. 15A–15F demonstrate the principle of toner transport particular to the fourth and fifth embodiments.

The pitch of the drive electrodes 164 in the circumferential direction of the developing roller 164 is suitably selected in relation to the drive force acting on the developing sleeve 167, drive speed, etc. For example, the pitch may range from 0.5 microns to 1.0 microns. The developing sleeve 167 has an inside diameter greater than the outside diameter of the developing roller 161, so that it may be smoothly rotated on the outer periphery of the roller 161. As shown in FIG. 14A, the developing sleeve 167 may have a two-layer structure made up of an insulating layer 169 and a conductive layer 170 made of metal or similar conductor. In addition, as shown in FIG. 14B, a dielectric layer 171 may be provided on the conductive layer 170. In such a configuration, an external electrode will be held contact with the conductive layer 170 to apply a bias voltage for development. As shown in FIG. 15A specifically, an insulating layer 169 forms the inner periphery of the developing roller 161 and is implemented as stripe-like charge portions extending in the lengthwise direction of the sleeve 167, i.e., the axial direction of the roller 161 at a predetermined pitch. The charge portions 169 are charged, for example in a predetermined positive and negative polarity pattern, so that they may be partly attracted or repulsed by predetermined ones of the drive electrodes 164 of the developing roller 161. The pitch of the charge portions 169 in the circumferential direction of the developing roller 161 may be the same as the pitch of the drive electrodes 164. Part of the charge portions 169 is not charged. The developing sleeve 167 is implemented as a thin layer (e.g. less than 100 microns thick) which is deformable on the developing roller 161 in a waving fashion.

The developing sleeve 167 is simply coupled over the developing roller 161 and does not have to be positioned in the radial direction of the roller 161. Regarding the axial direction of the developing roller 161, the roller 161 may be provided with, for example, abutments at axially opposite ends thereof for positioning the developing sleeve 167. It is noteworthy that the insulating layer 169 allows the toner to readily hold a frictional charge ascribable to, for example, the blade 166. If desired, the insulating layer 169 may be constituted by an insulating material capable of charging the toner to predetermined polarity by friction, further enhancing the frictional charge of the toner.

Voltages are applied to the electrode terminals 164*a*–164*c* of the developing roller, as will be described. Then, a driving force acts on the developing sleeve 167 due to the coaction of the charge of the sleeve 167 and the charge of the stationary body 165. As a result, the developing sleeve 167 is driven on the periphery of the developing roller 161, transporting the toner existing thereon.

Figure 15B:
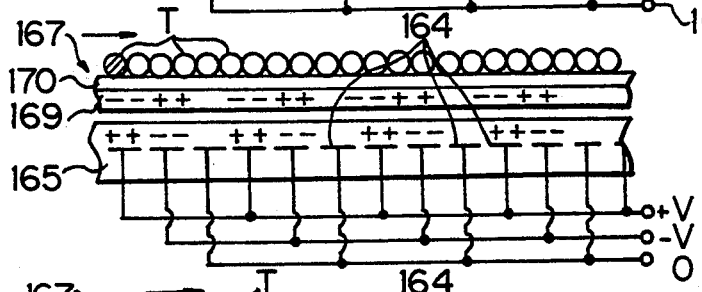
Figure 15C:
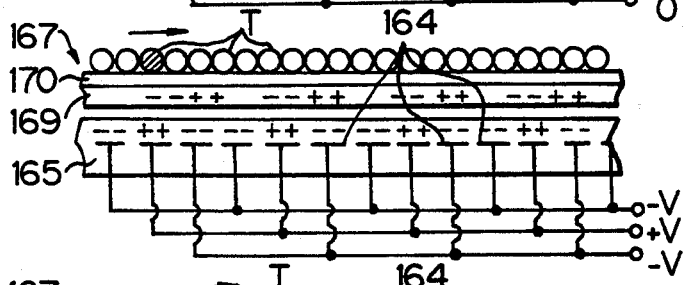
Figure 15D:
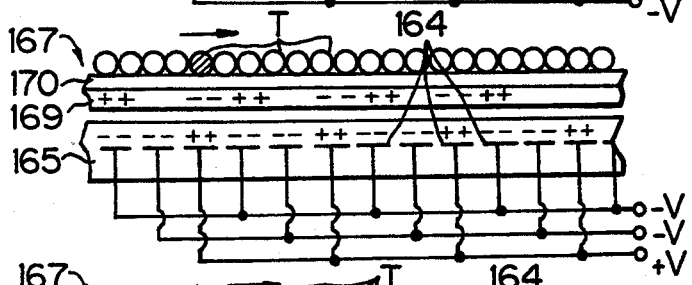
Figure 15E:
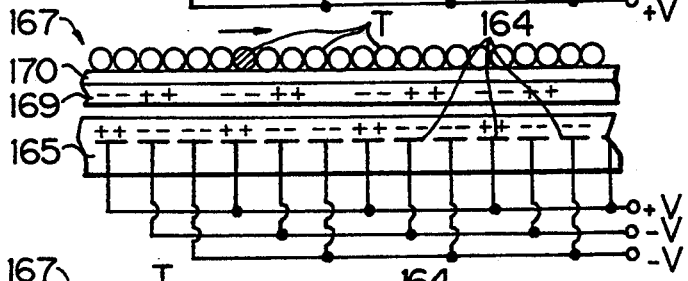
Figure 15F:
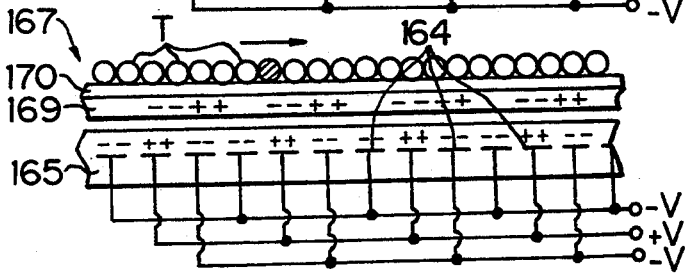

Referring to FIGS. 15A–5F, the principle of toner transport particular to this embodiment will be described. As shown in FIG. 15 A, in the initial condition wherein no voltages are applied to the electrode terminals 164*a*–164*c*, none of the drive electrodes 164 is charged. The toner T on the developing sleeve 167 is frictionally charged by the blade 166 to positive polarity or negative polarity. The developing sleeve 167 carrying the toner T thereon has the previously stated charged portions in a predetermined positive and negative polarity pattern. However, such charged portions are not effected by the drive electrodes 164 at all since no charges are deposited on the stationary body 165, so that the toner T is not transported. In this condition, the positive voltage +V, negative voltage −V and 0 V are respectively applied to the first, second and third electrode terminals 164*a*–164*c*, as shown in FIG. 15B. Then, the charged portions of the developing sleeve 167 are each attracted by the associated drive electrode applied with the voltage of opposite polarity. Specifically, the negative charged portions and the positive charged portions of the developing sleeve 167 are respectively attracted by the +V drive electrodes and the −V drive electrodes, contacting the corresponding portions of the surface of the developing roller 161. At this instant, the developing sleeve 167 is not attracted by and, therefore, do not contact the drive electrodes to which no voltages are applied. This, coupled with the fact that the inside diameter of the developing sleeve 167 is greater than the outside diameter of the developing roller 161, causes the sleeve 167 to deform in a waving fashion. Subsequently, as shown in FIG. 15C, −V, +V and —V are respectively applied to the first to third drive electrode groups, charging the drive electrodes 164 just underlying the charged portions of the developing sleeve 167 to the same polarity as the latter. The resulting repulsive forces cause the charged portions of the developing sleeve 167 to rise. At the same time, the charges of the third drive electrode group applied with −V repulse part of the charged portions of the developing sleeve 167 positioned at the upper right side thereof while attracting the charged portions positioned at the upper left side. As a result, a driving force acts on the sleeve 167 rightward. At this instant, the raising force reduces the friction between the inner periphery of the developing sleeve 167 and the surface of the developing roller 161, whereby the sleeve 167 is moved about one pitch of the drive electrodes 164 due to the drive force. Thereafter, the voltages are switched over as shown in FIG. 15D so as to shift the repulsion and drive pattern acting on the charged portions of the developing sleeve 167 one pitch. As shown in FIGS. 15E and 15F, the above procedure is repeated to apply voltages while shifting the drive electrodes one by one. As a result, the developing sleeve 167 is continuously moved.

The sequence of steps shown in FIGS. 15B–15F and the subsequent switchover of voltages to the electrode groups are listed in Table 3 below.

TABLE 3

| ELECTRODE GROUP | I | → | II | → | III | → | IV | → | ONWARD |
|---|---|---|---|---|---|---|---|---|---|
| 1ST GROUP | +V | → | −V | → | −V | → | +V | → | REPEAT II~IV |
| 2ND GROUP | −V | → | +V | → | −V | → | −V | → | REPEAT II~IV |
| 3RD GROUP | O | → | −V | → | +V | → | −V | → | REPEAT II~IV |

In Table 3, a step I corresponds to FIG. 15B, a step II corresponds to FIG. 15C, a step III corresponding to FIG. 14D, and a step IV corresponds to FIG. 15F. The steps II–IV are repeated to shift the voltages for the repulsion and drive of the toner one by one.

It is to be noted that in FIG. 15C (step II) +V may be applied to the third electrode group for reversing the drive direction.

As described above, this embodiment transports the toner T by rotating the developing sleeve 167, i.e., without rotating the developing roller 161. Since the developing roller 161 does not rotate, the increase in torque ascribable to eddy currents is eliminated while heat is suppressed to prevent the toner from melting.

The embodiment causes the blade 166 to contact the developing sleeve 167 at a position below the center of the developing roller 161. In this configuration, the excessive toner T shaved off by the blade 166 and accumulated in the position below the position were the sleeve 167 and blade 166 contact is let fall by gravity. Since the toner T should be deposited on the developing sleeve 167 in a thin layer, preferably in a single layer, to effect desirable development, the excessive toner T separated by the blade 166 is let fall by gravity. Should the blade 166 contact the developing sleeve 167 at a position above the center of the developing roller 161, the excessive toner T intercepted by the blade 166 would accumulate between the sleeve 167 and the blade 166 to obstruct the movement of the sleeve 167 or would be transported to the developing region to make the resulting images defective.

This embodiment is practicable not only with the nonmagnetic one-component developer, i.e., toner described above, but also with a magnetic toner only if the developing sleeve 167 is magnetized. For this purpose, in the developing sleeve 167 shown in FIG. 14B, for example, the dielectric layer 171 may be implemented by a rubber magnet which is finely magnetized. e.g., one pole per 1 millimeter to 1.5 millimeters and has a flux density of 200–300 gauss. The toner supply roller 162 may be implemented as a rotary bar since it has only to convey the magnetic toner driven by the agitator 163 to the neighborhood of the developing sleeve 167. Further, even a two-component developer may be used, if desired.

5th EMBODIMENT

While the fourth embodiment described above provides the inner periphery of the developing sleeve 167 with the positive and negative charged portions, a fifth embodiment provides it with charged portions of single polarity, e.g., positive polarity. Such charged portions are arranged, for example, every three drive electrodes 164 (one charging portion corresponding to one of three drive electrodes 167). To move the developing sleeve 167 to the right relative to the developing sleeve 167, as shown in FIGS. 15A–15F, voltages are applied to the first to third electrode groups, as listed in Table 4 below.

TABLE 4

| ELECTRODE GROUP | I | → | II | → | III | → | IV | → | ONWARD |
|---|---|---|---|---|---|---|---|---|---|
| 1ST GROUP | +V | → | +V | → | −V | → | +V | → | REPEAT II~IV |
| 2ND GROUP | −V | → | +V | → | +V | → | −V | → | REPEAT II~IV |
| 3RD GROUP | O | → | −V | → | +V | → | +V | → | REPEAT II~IV |

Again, in FIG. 15C (step II) the positive voltage and the negative voltage may be respectively applied to the third electrode group and the first electrode group so as to drive the developing sleeve 167 in the reverse direction.

The fourth embodiment is also practicable with a magnetic toner or a tow-component developer, as desired.

6th EMBODIMENT

As the voltage pattern to be applied to the drive electrodes groups is changed in period, i.e., in frequency, the transport speed of the toner on the developing roller 161 changes. By taking advantage of this fact, this embodiment changes the image density by changing the amount of toner to be transported by the developing roller 161. Specifically, as the frequency increases, the step of the drive electrode groups of the electrostatic actuator increases in speed. Then, the toner on the developing roller 161 is transported at a higher speed and, therefore, deposited on the drum 1 in a greater amount per unit time, increasing image density. Conversely, as the frequency decreases, the step of the actuator is lowered in speed to slow down the transport of the toner on the developing roller 161. This reduces the amount of toner deposition per unit time on the drum 1 and, therefore, image density.

Also, when the amount (amplitude) of voltage to the actuator is changed, the voltage to each drive electrode 164 and, therefore, the amount of toner to deposit on the developing roller 161 per unit time changes. This is also used to change image density in the illustrative embodiment. Specifically, when the amplitude is increased, the electrostatic adhesion between the actuator and the toner and, therefore, between the blade 166 (see FIG. 13) and the surface of the developing roller 161 increases. As a result, a greater amount of toner is transported to the surface of the drum 1 via the blade 166, increasing image density. Conversely, when the amplitude is reduced, the electrostatic adhesion between the blade 166 and the roller 161 decreases to reduce the amount of toner transport to the drum 1 and, therefore, image density.

For example, control means may be provided for changing, in response to a signal from a manual density select key, the frequency and/or the amplitude of the voltage to be applied to each electrode 164. In such a case, the control means will send a control signal to a drive circuit connected to the electrodes 164 so as to control image density. Alternatively, an arrangement may be made such that a reference toner image is formed on the drum 1 and sensed by a photosensor. Then, the frequency and/or the amplitude will be automatically controlled to set up constant density in response to the output of the sensor.

7th EMBODIMENT

This embodiment relates to a developing unit applicable to a multicolor copier, e.g., bicolor copier. For example, the developing unit is implemented as two developing units accommodating a black toner and a red toner, respectively. One of the developing units is moved from an inoperative position remote from the drum 1 to an operative position close thereto only when it is to be used. This prevents the toners from being accidentally moved from the developing rollers of the developing units to the drum 1 and mixed on a paper. A reference will be made to FIGS. 16A and 16B for describing two developing units particular to the embodiment. It is to be noted the two developing units store, for example, a red toner and a black toner, respectively, and are identical in construction except for the color of the toner.

Figure 16A:
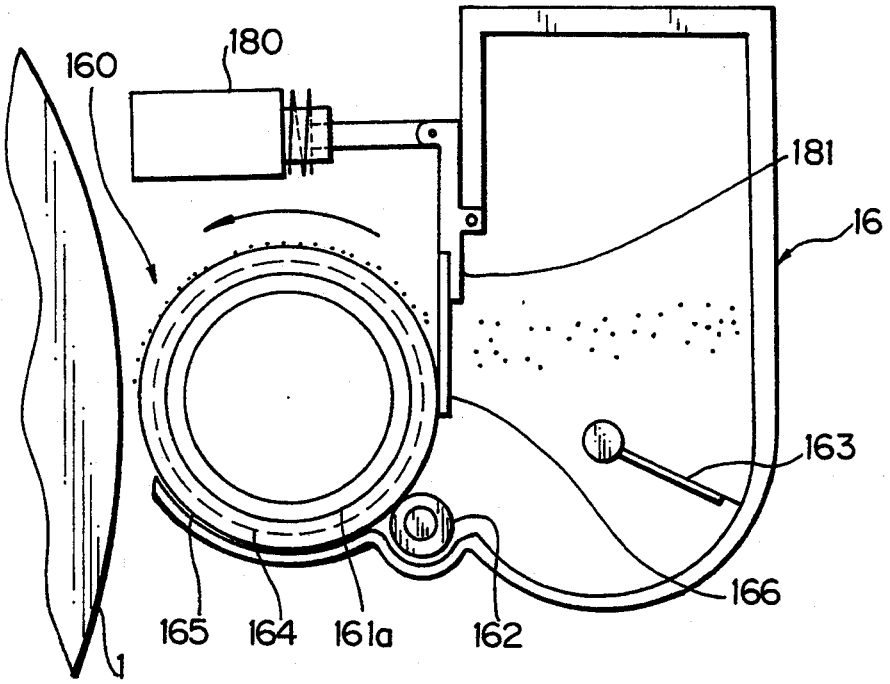
FIGS. 16A and 16B are sections showing a developing unit representative of a seventh embodiment of the present invention.
Figure 16B:
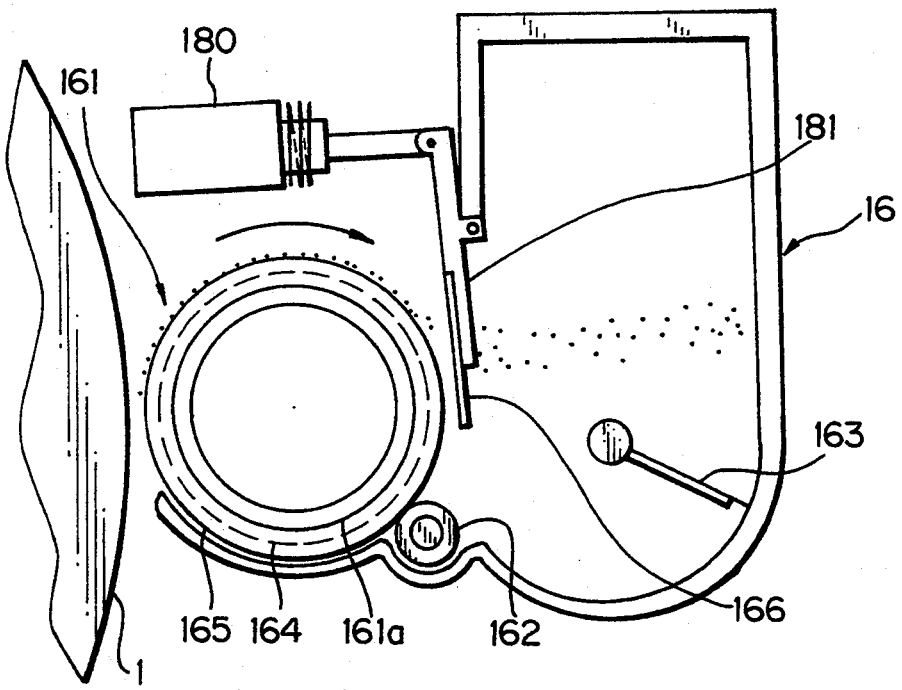

As shown in FIGS. 16A and 16B, each developing unit 16 has the developing roller 161, blade 166, agitator 163, and charging roller or toner supply roller 162. The torque of the agitator 163 is sensed by a sensor, not shown. When the torque of the agitator 163 decreases to below a predetermined value, it is determined that the toner hopper formed by the casing of the developing unit 16 has run out of the toner. In this embodiment, the surface of the developing roller 161 and that of the drum 1 are spaced apart a distance greater than the thickness of the toner layer so as to effect non-contact type development. Of course the non-contact type development may be replaced with contact type development which holds the toner layer in contact with the drum 1, if desired.

The developing roller 161 is identical in construction with the developing roller shown in FIG. 2. The toner supply roller 162 has an elastic surface layer and rotated counterclockwise while contacting the developing roller 161 over a predetermine nip width. The blade 166 is affixed to the lower end of a blade holder 181. The blade holder 181 is rotatably connected to the casing and is operatively connected to the plunger of a solenoid 180 at the upper end thereof. As the solenoid 180 is selectively turned on or turned off, the blade 166 assumes a position shown in FIG. 16A or a position shown in FIG. 16B. In the position of FIG. 16A, the blade 166 contacts the surface of the developing roller 161 while, in the position of FIG. 16B, the former is spaced apart a predetermined distance from the latter. A spring constantly biases the plunger of the solenoid 180 outward, so that the blade 166 may remain in contact with the developing roller 161 while the solenoid 180 is turned off. How the electrostatic actuator transports the toner in a predetermined direction is the same as in the second embodiment and will not be described specifically to avoid redundancy.

In operation, when one of the two developing units 16 is in development, a control section causes the power source unit to apply a predetermined voltage to each of the drive electrodes 164 of the actuator. This allows the toner to be transported counterclockwise on the surface of the developing roller 161. Before this developing unit starts operating, the solenoid 180 thereof is changed from an ON state to an OFF state by the control section, bringing the blade 166 into contact with the developing roller 161. The agitator 163 conveys the toner from the toner hopper toward the developing roller 161 with which the blade 166 contacts. The toner supply roller 162 conveys the toner from the agitator 163 further to the developing roller 161. Then, the toner is frictionally charged by the nip portion of the rollers 161 and 162 and deposited on the roller 161. The toner supply roller 162 also serves to remove the toner which remains on the developing roller 161 after development. As the toner deposited on the developing roller 161 reaches the blade 166, the blade 166 further charges the toner to a predetermined polarity by friction while forming a thin toner layer on the roller 161. The thin toner layer is brought to the developing position where the the developing roller 161 faces the drum 1. As a result, the toner is transferred to a latent image formed on the drum 1 to develop it. The toner left untransferred to the drum 1 is returned to the developing unit 16 and then removed by the toner supply roller 162.

The above operation of the developing unit 16 is ended when, for example, the other developing unit 16 is to operate or when the entire copier i s to assume a waiting state on completing the copying operation. At this instant, the developing unit 16 having developed a latent image will b e controlled as follows.

To begin with, the toner supply roller 162 is brought to a stop while the solenoid 180 is turned off to move the blade 166 away from the developing roller 161. Then, the power source unit is switched over to apply voltages which will move the toner clockwise on the developing roller 161 to the drive electrodes 164 of the actuator. As a result, the toner existing on part of the developing roller 161 exposed to the outside is collected in the developing unit 16. Preferably, the distance between the blade 166 in the inoperative or retracted position and the developing roller 161 should be greater than the thickness of the toner layer to be returned to the developing unit 16. After the collection of the toner has been continued over a predetermined period of time, the voltage application to the actuator is interrupted while the solenoid 180 and agitator 163 are turned off. If desired, the agitator 163 may be turned off before the end of the collection of the toner, e.g., before the collection begins.

As stated above, before the end of operation of the developing unit 16, the embodiment moves the blade 166 away from the developing roller 161 and reverses the direction of toner transport on the roller 161 to collect the toner in the unit 16. Consequently, the toner of the developing unit 16 is prevented from depositing on the drum 1 while the unit 16 is out of operation.

This embodiment also transports the toner by the principle of an electrostatic actuator, i.e., without causing the developing roller 161 to rotate. Otherwise, the toner would enter portions being rubbed by a developing roller in rotation and stick fast due to the resulting stress. In addition, since the developing roller 161 does not rotate, the increase in torque and the generation of heat due to eddy currents are reduced to prevent the toner from melting in the developing unit 16.

In the embodiment, when the toner is collected in the developing unit 16 before the unit 16 ends operating, the blade 166 and drum 1 are spaced apart a distance greater than the thickness of the toner layer. This insures desirable toner collection. The distance, however, may be smaller than the thickness of the toner layer so long as the pressure acting between the developing roller 161 and the blade 166 is low enough to allow the toner to pass.

The toner supply roller 162 is omissible if the blade 166 is capable of charging the toner to such an extent that the toner deposits in a sufficient amount on the developing roller 161.

Figure 17A:
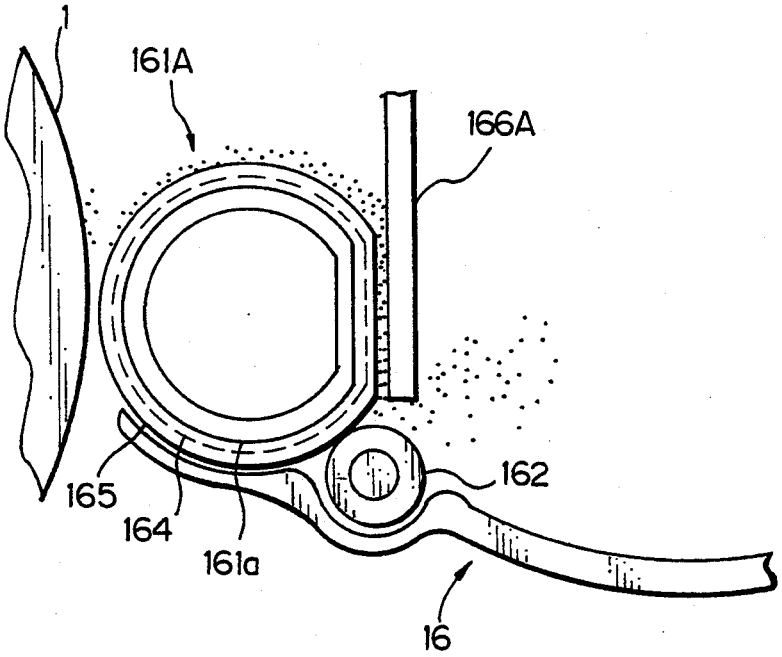
FIGS. 17A–17C are sections each showing a modified configuration of a developing roller and a toner thickness regulating member included in the seventh embodiment.
Figure 17B:
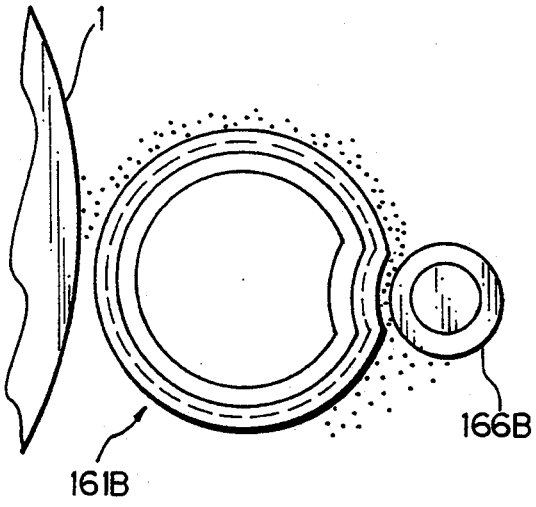
Figure 17C:
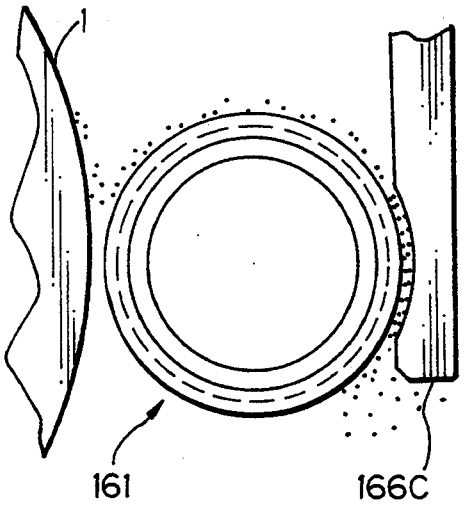

FIGS. 17A–17C each shows a modified arrangement of the developing roller 161 and toner layer regulating member 166. The toner layer regulating member 166 may be implemented by a rod in place of a blade, as proposed in the past. In any case, a toner layer regulating member forms a thin toner layer in line-to-line contact with a developing roller. To form a uniform toner layer, the prerequisite is that the blade or the rod contacts the developing roller 161 with a uniform pressure distribution. However, the blade or the rod is apt to bend or otherwise deform, making it difficult to set up a uniform pressure distribution. This is especially true when use is made of a developing roller having a great axial length. Particularly, it is difficult to form a thin toner layer by the line-to-line contact of the blade of the rod as in the above embodiment. By contrast, when use is made of a blade or a rod complementary in shape to a developing roller or a developing roller complementary to a blade or a rod, a uniform thin layer can be implemented by surface-to-surface contact. In addition, this reduces the damage to the developing roller and blade or rod due to friction or similar cause, thereby enhancing the service life of the developing unit.

Specifically, FIG. 7A shows a horizontally extending blade 166A and a developing roller 161A which is partly formed flat in matching relation to the blade 166A. In this configuration, the developing roller 161A and blade 166A make surface-to-surface contact with each other. FIG. 17B shows a regulating member in the form of a rod 166B, and a developing roller 161B complementary in shape to the rod 166B. The rod 166B and developing roller 161B also make surface-to-surface contact with each other. Another advantage of such a configuration is that the surface-to-surface contact extends the distance and, therefore, the period of time available for regulation, thereby realizing a uniform thin layer with accuracy. FIG. 17C shows a blade 166C matching in shape to the cylindrical developing roller 161.

As described above, the embodiment also uses an electrostatic actuator to transport a toner and, therefore, makes it needless to rotate the developing roller. It follows that the developing roller can be provided with any desired configuration so long as it does not obstruct the transport of the toner. Specifically, the developing roller may be so configured as to make surface-to-surface contact with the toner layer regulating member, thereby insuring a thin toner layer with accuracy. The selective voltage application to the drive electrodes 164 of the developing roller 161, 161A or 161B and the movement of the regulating member toward and away from the developing roller are also effected to prevent the toner from depositing on the drum 1 while the developing unit is out of operation. This is also successful in preventing the toner from being scattered around in the developing unit.

8th EMBODIMENT

In the above embodiments, the electrostatic actuator transports the toner in a direction perpendicular to the drive electrodes 164. This, however, brings about a problem when the toner is accidentally shifted to the end portions of the developing roller 161 in the widthwise direction. Specifically, part of the toner brought out of the drive range of the drive electrodes 164 would accumulate in the end portions of the developing roller and would in due course solidify, adhere or drop to lower image quality.

To eliminate the above problem, this embodiment provides the developing roller 161 with a first and a second electrostatic actuator portion, or simply actuator as referred to hereinafter. The first actuator extends in the circumferential direction perpendicular to the axis of the developing roller 161 to transport the toner, as in the previous embodiments. The second actuator is located outside of each end of the first actuator in to the axial direction of the developing roller 161. When the toner is moved to the outside of opposite ends of the first actuator by accident, the second actuator returns it to the first actuator.

Figure 18A:
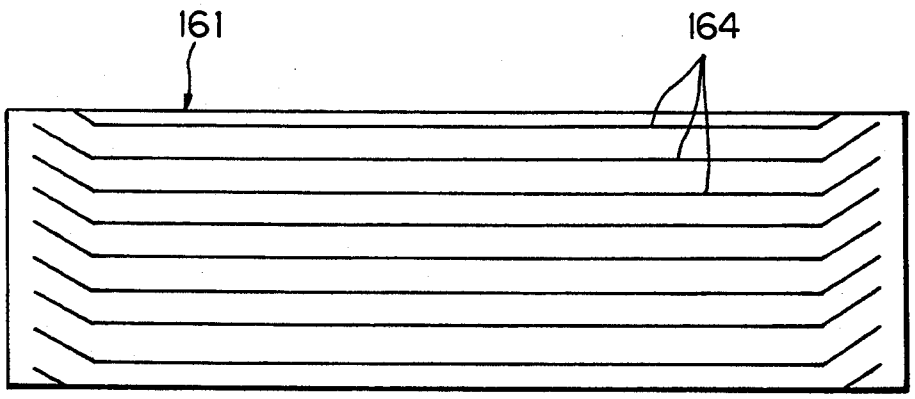
FIGS. 18A–18C each shows a specific configuration of a developing roller representative of an eighth embodiment of the present invention.

As shown in FIG. 18A specifically, the first and second actuators may be implemented by the drive electrodes 164 buried in the stationary body 165 and each having a straight portion and bent portions. The straight portion is parallel to the axis of the developing roller 161 to constitute the first actuator while the bent portions are each bent a predetermined angle relative to the axis of the roller 161 to constitute the second actuator. Preferably, the straight portion should cover a developing range corresponding to a latent image of maximum allowable width in the axial direction of the drum 1, and the bent portions should be located outside of the developing range. This is because the toner is apt to accumulate on the developing roller 161 near the bent portions. For example, assuming that the latent image of maximum size corresponds to a paper of A3 size, the straight portion is provided with a length of more than 297 millimeters. In FIG. 18A, the drive electrodes 164 buried in the stationary body 165 are represented by solid lines. The drive electrodes 164 are shown at a pitch far greater than the actual pitch for the sake of illustration. This is also true with FIGS. 18B. 18C 19A, 19B, 20A and 20B which will be referenced.

Figure 18B:
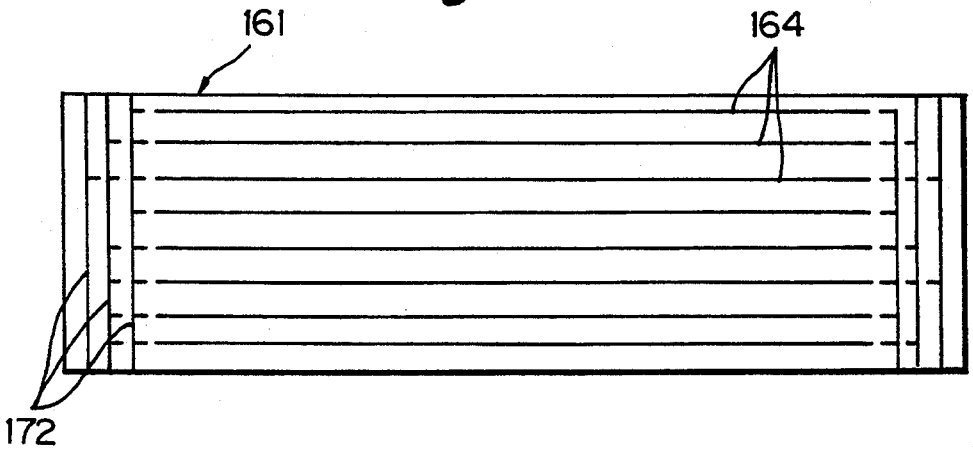
Figure 18C:
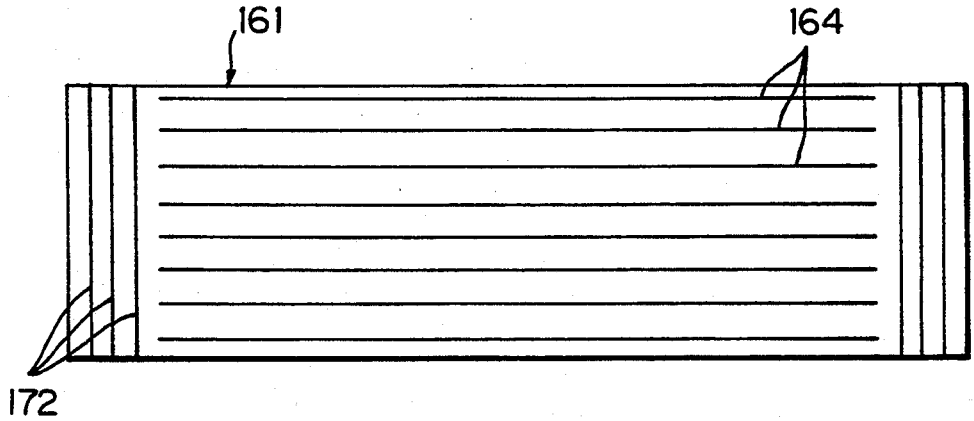

As shown in FIGS. 18B and 18C, the first and second actuators may each be implemented as exclusive drive electrodes 164 or 172. Specifically, the first actuator is implemented by straight drive electrodes 164 parallel to the axis of the developing roller 161. The second actuator is implemented by three annular drive electrodes 172 located outside of each end of the first actuator and perpendicular to the axis of the roller 161. Again, the first actuator or drive electrodes 164 should preferably cover the developing range corresponding to the latent image of maximum allowable size.

In FIG. 18B, the drive electrodes 164 and 172 are electrically connected, as indicated by phantom lines. The drive electrodes 164 and 172, therefore, share part of the voltage application path from the power source unit, so that the first and second actuators begin and end to be driven at the same time. By contrast, in FIG. 18C, the drive electrodes 164 and the drive electrodes 172 are each connected to the power source unit by an exclusive conduction path, not shown. This allows each of the two actuators to be driven independently of the other and driven by a particular force. For example, an arrangement may be made such that the first actuator is driven under a condition matching the expected toner transport on the developing roller 161 and the development, while the second actuator is driven under a condition necessary and sufficient for the toner brought out of the drive range of the first actuator to be returned thereto (drive force smaller than one necessary for the first actuator to transport the toner).

Figure 19A:
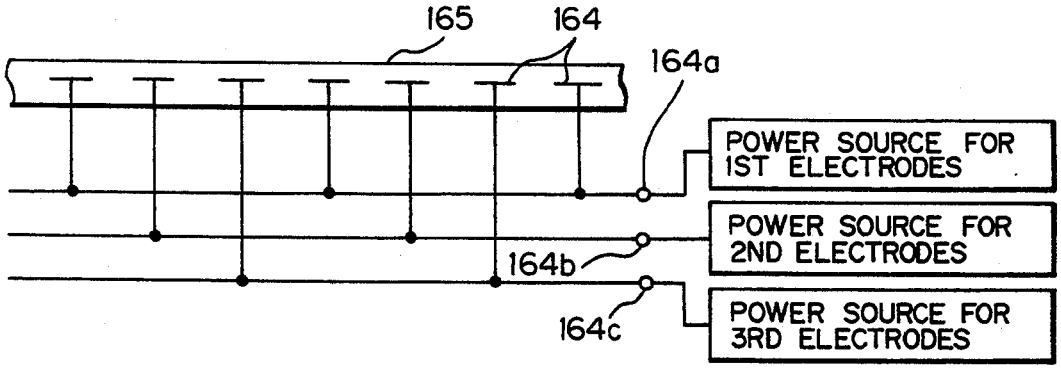
FIGS. 19A and 19B show a specific arrangement of electrostatic actuators included in the eighth embodiment.
Figure 19B:
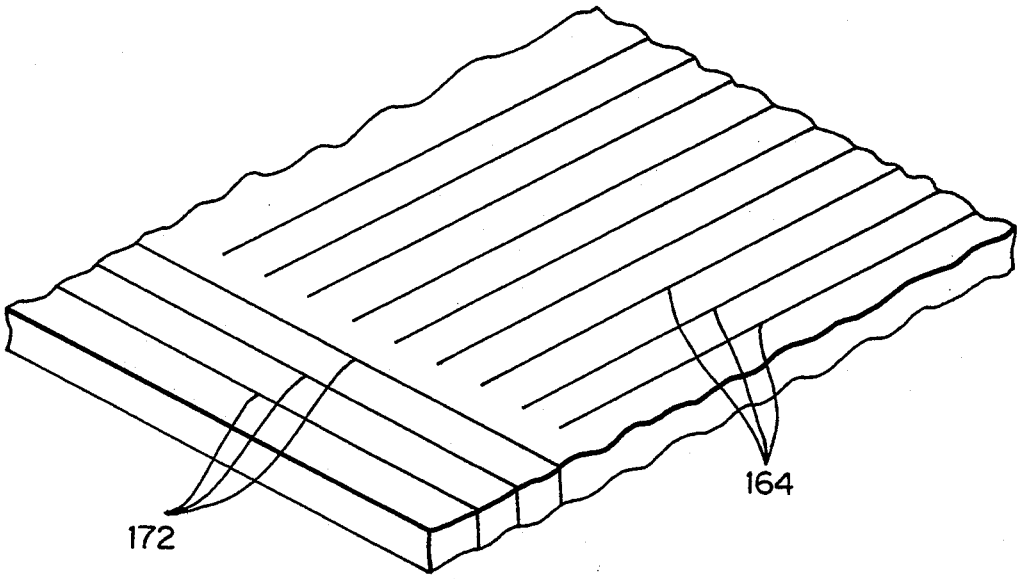

FIG. 19A shows specific electric connection of the first actuator or drive electrodes 164 and power source unit. FIGS. 19B shows a specific allocation of the first to third electrode groups in the drive electrodes 164 and 172 shown in FIGS. 18A and 18B.

As stated above, in the specific configurations shown in FIGS. 18A–18C, the first actuator transports the toner in the circumferential direction perpendicular to the axial direction of the developing roller 161. On the other hand, the second actuator returns the toner accidentally moved to the outside of opposite ends of the first actuator by some unexpected force. This is successful in surely transporting the toner by preventing it from dropping from the ends of the developing roller 161. Hence, the occurrence ascribable to such a toner stated earlier is eliminated. Since the toner brought out of the drive range of the first actuator is returned by the second actuator, the toner to simply accumulate at the outside of the drive range without contributing to development is minimized. This promotes the efficient use of the toner.

Figure 20A:
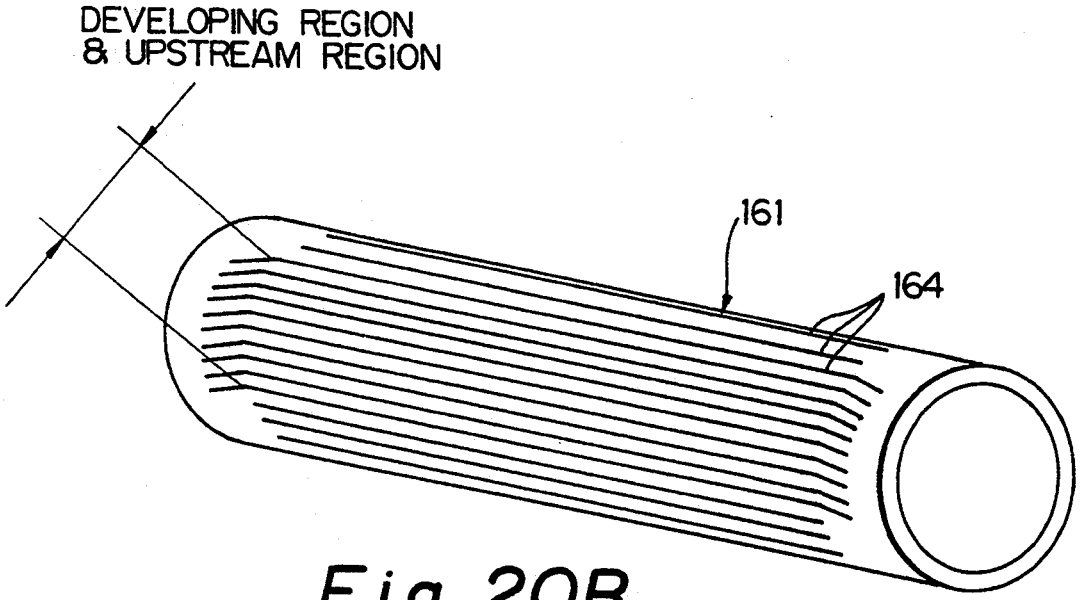
FIGS. 20A and 20B are perspective views each showing a modification of the configurations of FIGS. 18A–18C.
Figure 20B:
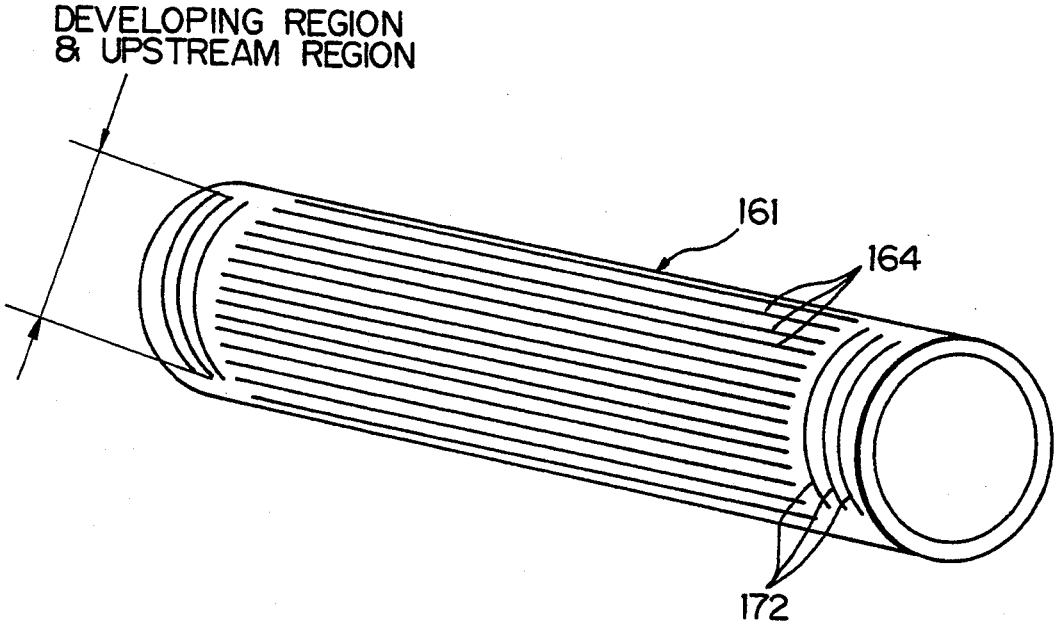

In the specific configurations described above, the second actuator, like the first actuator, is provided over the entire circumference of the developing roller 161. Alternatively, a s shown in FIGS. 20A or 20B, the second actuator may be provided only in the developing region where the developing roller 161 faces the drum 1 and a predetermined region upstream of the developing region with respect to the direction of toner transport. FIGS. 20A and 20B correspond to FIG. 18A and FIGS. 18A and 18C, respectively. The modifications shown in FIGS. 20A and 20B are especially effective to prevent the toner from adhering to the ends of the developing roller 161 or from dropping therefrom onto, for example, a paper being transported.

Regarding the configuration of FIG. 18C which allows the first and second actuators to be driven independently of each other, control may be so executed as to drive the second actuator only when needed. Specifically, toner accumulation sensing means may be used to determine whether or not the toner has accumulated on the second actuator, in which case the second actuator will be driven only when the sensor senses the toner. The sensing means may be implemented by a reflection type or transmission type photointerrupter by way of example. As the toner begins to accumulate on the second actuator, the reflectance or the transmittance falls in the case of the reflection type photointerrupter or the transmission type photointerrupter respectively. A relay or a switch, a driver and so forth may be operated to drive the second actuator in response to the output of the photointerrupter.

Figure 21:
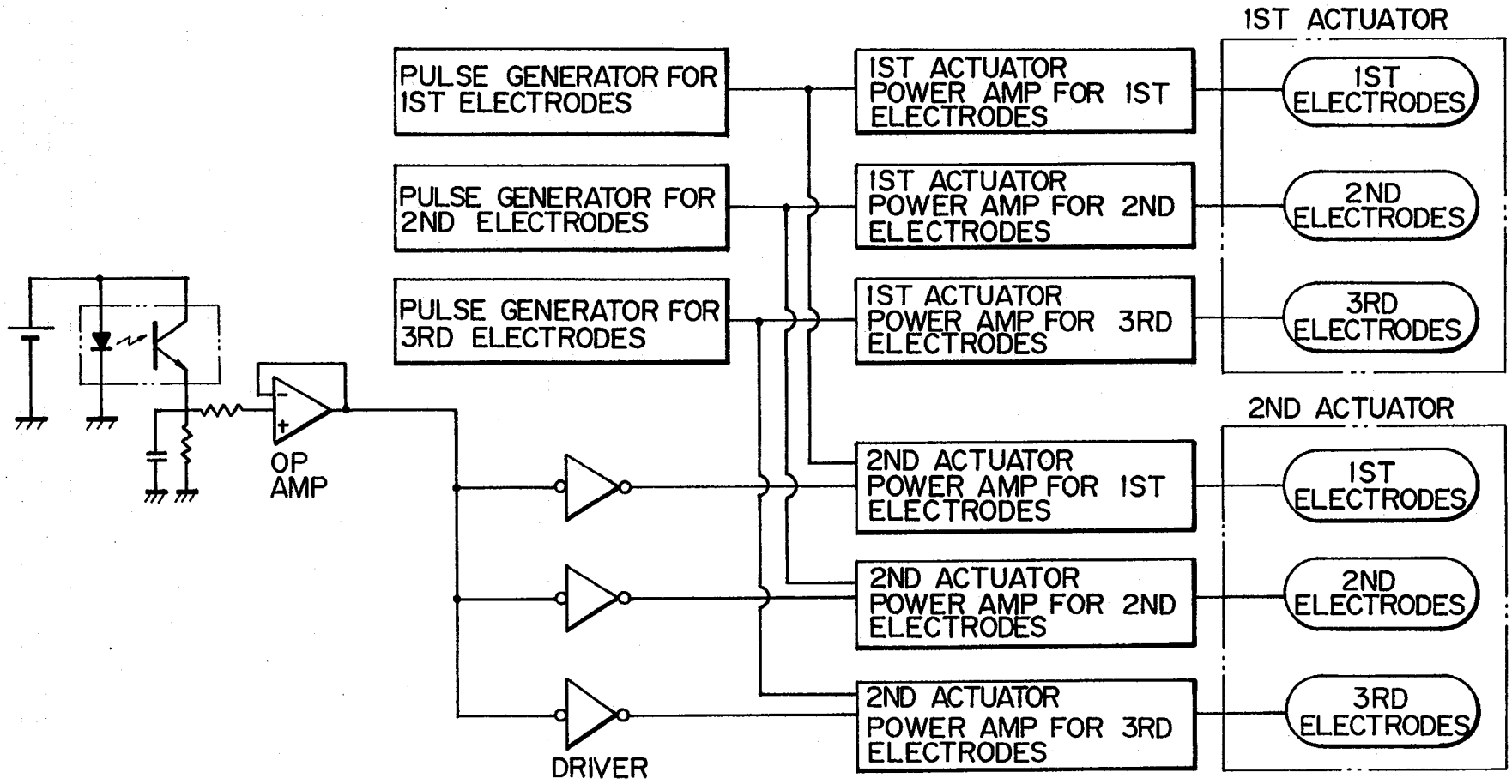
FIG. 21 is a block diagram schematically showing control circuitry associated with the electrostatic actuators of FIG. 18C.

FIG. 21 shows specific circuitry for executing the above-described control. As shown, the output of the toner accumulation sensing means. e.g., photointerrupter is amplified by an operational amplifier (OP AMP) and then applied to drivers. The resulting outputs of the drivers are each used as a signal for activating or deactivating an associated power amplifier which is assigned to one of the first to third electrodes of the second actuator. In this circuitry, power amplifiers and pulse generators for applying drive voltages to the first to third electrodes of the first actuator are shared by the second actuator.

Figure 22:
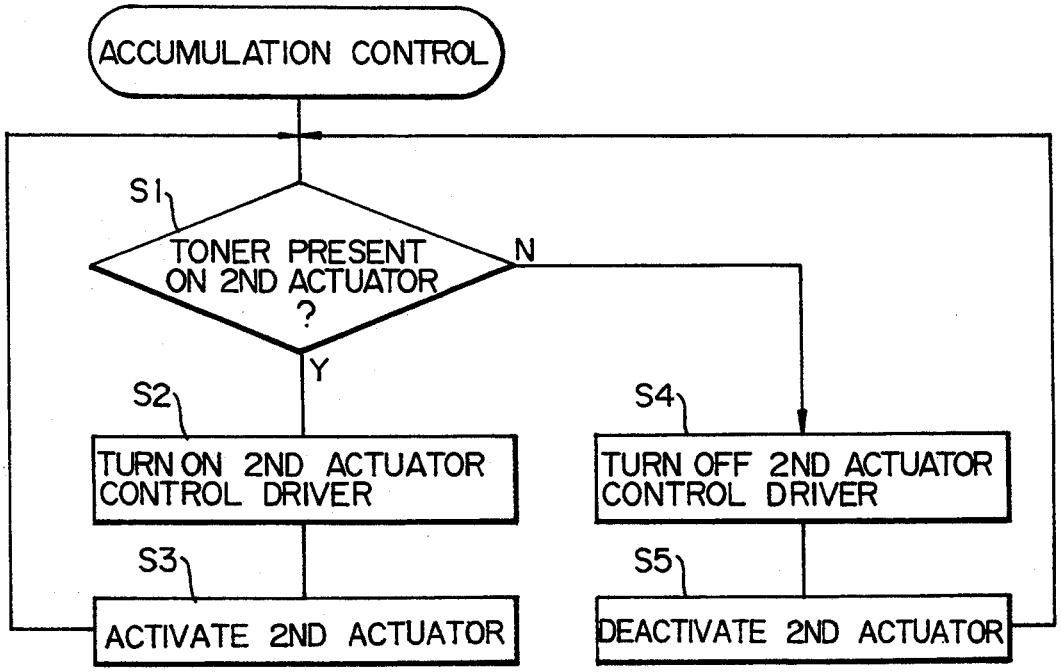
FIG. 22 is a flowchart demonstrating a specific operation of the circuitry of FIG. 21.

FIG. 22 is a flowchart demonstrating a specific control procedure using the outputs of the toner accumulation sensing means. As shown, the second actuator is constantly monitored to see if the toner has deposited thereon (step S1 ). As the toner is sensed on the second actuator (Y, S1), the driver for the second actuator is turned on (S2 and S3). If the toner is not deposited (N, S1), the driver for the second actuator is turned off (S4 and S5).

The drive electrodes of the second actuator may be arranged at a smaller pitch than the drive electrodes of the first actuator, if desired. Then, the field strength acting on the charged toner deposited on the stationary body can be increased, as will be seen from the principle described above. Therefore, the second actuator can be more surely driven and can return the toner more rapidly to the first actuator. This is particularly desirable when the second actuator is provided only in the developing region and the region upstream of the developing region, as shown in FIG. 20A. In the arrangement of FIG. 20A, it is also desirable to arrange the bent portions such that the drive pitch thereof sequentially decreases from the inner end toward the outer end.

As described above, even when the toner penetrates the gaps between the side wall s of the developing unit and the developer carrier, the embodiment prevents it from adhering to them and, therefore, eliminates troubles ascribable to such an occurrence. Even when the developer carrier is of the kind accommodating a magnet roller, there can be eliminated the increase in torque and the generation of heat due to eddy currents. Furthermore, the embodiment surely retains the toner within the developing region, i.e., prevents the toner or developer from moving toward opposite ends of the developer carrier. Hence, the embodiment reduces not only the scattering and fall of the toner which directly effect image quality, but also the adhesion of toner and other troubles to occur within the developing unit as well as the influence thereof on image quality.

9th EMBODIMENT

This embodiment pertains to a developing unit capable of transporting the toner removed from the developing roller in a transverse direction while agitating it.

Figure 23:
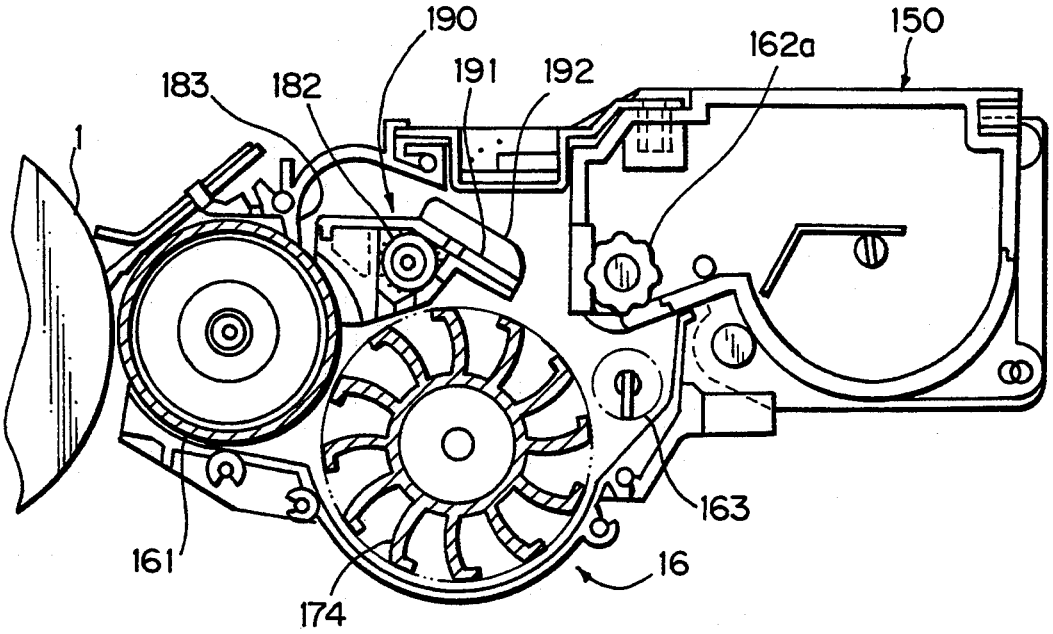
Fig. 23 PRIOR ART
FIG. 23 is a section of a conventional developing unit to which a ninth embodiment of the present invention is applicable.
Figure 24:
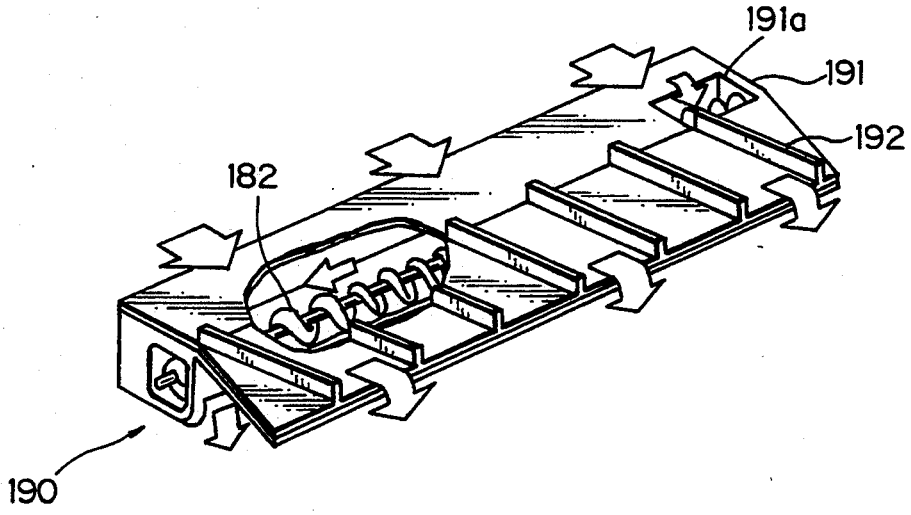
Fig. 24 PRIOR ART
FIG. 24 is a perspective view of a separator included in the developing unit of FIG. 23.

To begin with, a reference will be made to FIGS. 23 and 24 for describing the general construction of a developing unit to which the embodiment is applicable. As shown, the developing unit has a toner supply roller 162*a*, a paddle 174, a conveyor in the form of a screw 182, a doctor blade 183 and a separator 190 in addition to the toner hopper 150, agitator 163, and developing roller 161. A developer made up of a toner and a carrier is accommodated in the developing unit. The paddle 174 drives the developer to the developing roller 161. As the developing roller 161 carrying the developer thereon is brought into contact with the drum 1, the toner contained in the developer is transferred to a latent image formed on the drum 1. When the toner concentration of the developer decreases, a toner concentration sensor, not shown, senses it. Then, the toner supply roller 162*a* disposed in the toner hopper 150 is driven to supplement a toner to the developing unit. The supplementary toner is mixed with the developer by the agitator 163 and then conveyed to the developing roller 161 by the paddle 174. The supplementary toner sharply increases the toner concentration of the developer for a moment. However, such a toner is agitated and transported by the screw 182 together with the other developer, setting up a uniform toner concentration in the developing unit, as will be described later.

The developer deposited on the developing roller 161 has the thickness thereof regulated by the doctor blade 183. Part of the developer removed by the doctor blade 183 is pushed by the following developer from behind and caused to move along the flat upper surface of the separator 190 to the right, as viewed in FIG. 23. Then, this part of the developer flows down along an inclined guide plate 191 until it falls onto the paddle 174.

The separator 190 is hollow inside and accommodates the screw 182 therein. The screw 182 plays the role of transporting and agitating means for transporting the developer toward the front end of the developing unit, i.e., in the transverse direction or axial direction of the developing roller 161. As shown in FIG. 24, the hollow of the separator 190 is communicated to the interior of the casing of the developing unit by an opening or developer inlet 191*a* formed through the upper wall of the separator 190, and a developer outlet formed through the front end of the separator 190. As also shown in FIG. 24, a plurality of inclined fins 192 are provided on the upper surface of the guide plate 191 to cause the developer to flow down while guiding it toward the rear end of the developing unit.. The screw 182 and the fins 192 of the guide plate 191 cooperate to transport the developer in the transverse direction. At the same time, the guide plate 191, paddle 174, developing roller 161 and doctor blade 183 transport the developer in the longitudinal direction. As a result, the developer is circulated in the developing unit. The circulation of the developer is repeated at high speed to provide the entire developer in the developing unit with a uniform toner concentration.

However, the problem with the above construction is that the developer cannot be desirably conveyed or agitated in the transverse direction unless the inclination of the guide plate 191, the inclination and number of the fins 192, and the contour, pitch and rotation speed of the screw 182 are held in a strict relation and well balanced. This requires delicate and difficult adjustment. Moreover, the transverse transport and agitation needs a great number of parts and complicated configuration, resulting in the increase in cost.

Figure 25:
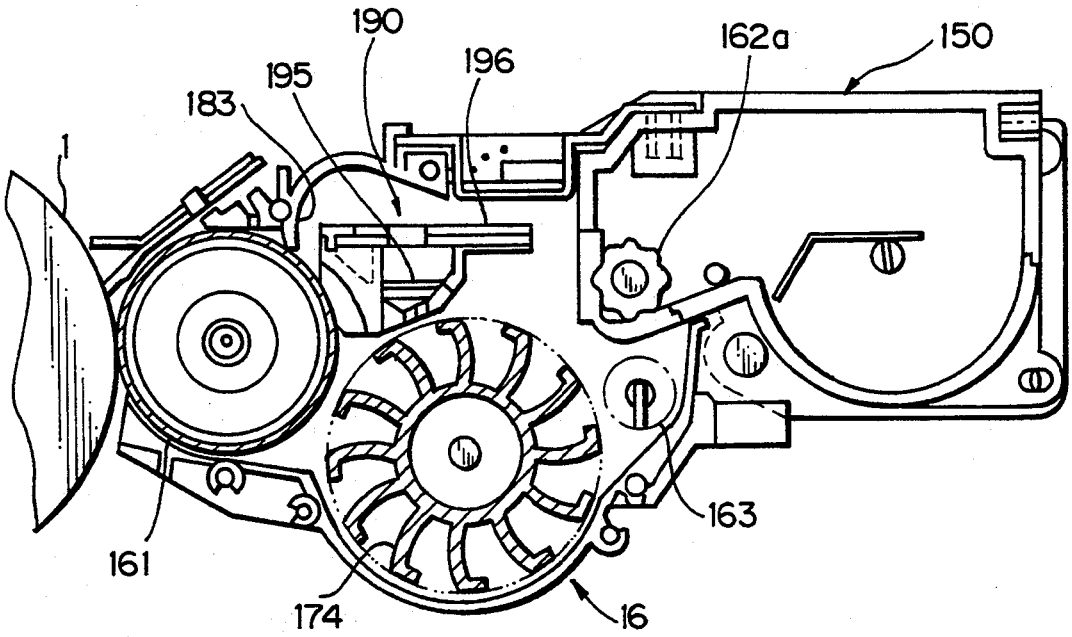
FIG. 25 is a section showing the ninth embodiment of the present invention.

Referring to FIGS. 25 and 26A–26C, the developing unit 16 representative of this embodiment will be described. This embodiment is identical with the conventional developing unit 16 of FIG. 23 except for the structure relating to the separator 190. In FIG. 25, the same constituent parts as those shown in FIG. 23 are designated by the same reference numerals.

Figure 26A:
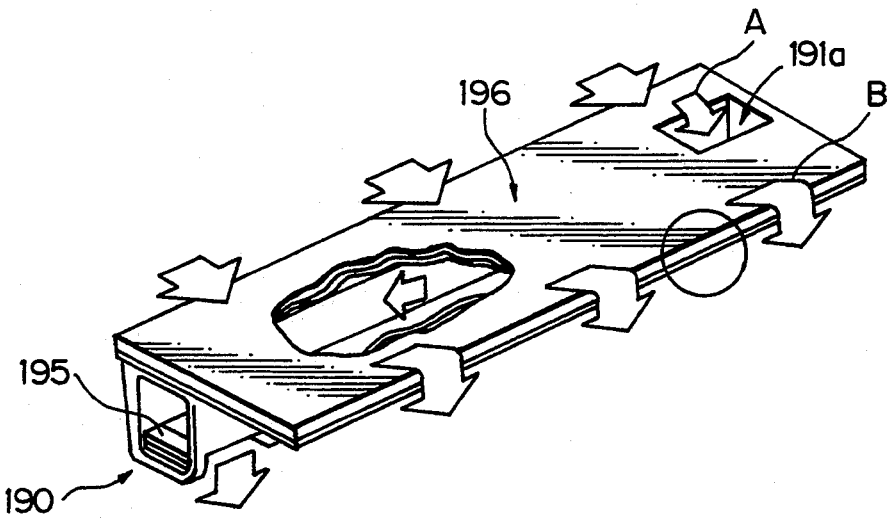
FIG. 26A is a perspective view of a separator included in the ninth embodiment.
Figure 26B:
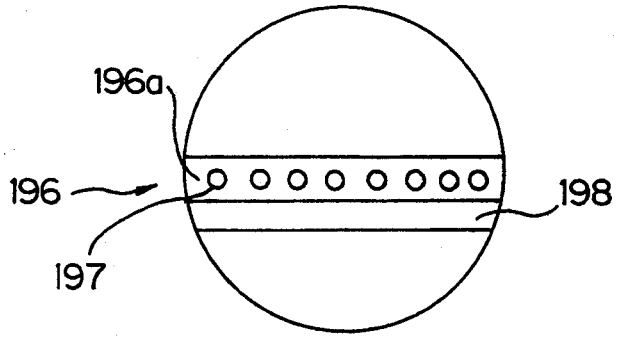
FIG. 26B is a fragmentary enlarged view of an upper electrostatic actuator forming part of the separator of FIG. 26A.

As shown, the separator 190 of the embodiment has a lower electrostatic actuator 195 and an upper electrostatic actuator 196. The lower actuator 195 is disposed in the hollow of the separator 190 in a horizontal position in place of the conventional screw 182. The upper actuator 196 extends horizontally in place of the inclined guide plate 191 and forms the upper wall of the separator 190. A developer inlet 191*a* is formed through rear part of the upper actuator 196 to let the developer to fall into the hollow of the separator 190 (see FIG. 26A). Basically, the upper and lower actuators 196 and 195 are identical in construction. For example, as shown in FIG. 26B, the actuators 195 and 196 are each made up of an insulative stationary body 196*a* and a plurality of drive electrodes 197 buried the body 196*a*. In FIG. 26B, the reference numeral 198 designates a base plate on which the stationary body 196*a* is provided.

Figure 26C:
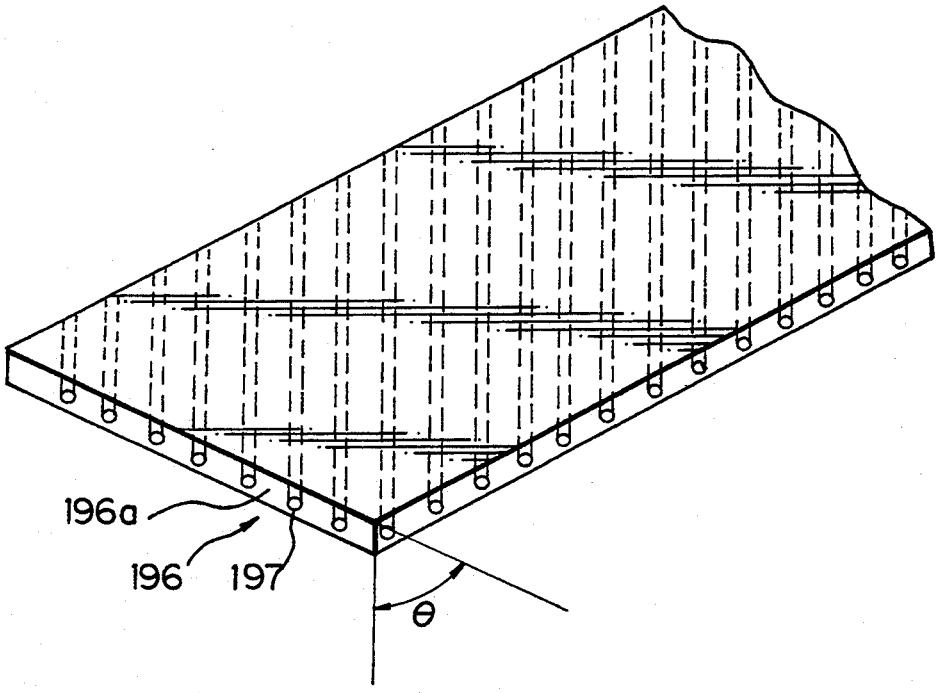
FIG. 26C is a perspective view of the upper electrostatic actuator.

The drive electrodes 197 are implemented as parallel elongate electrodes. As shown in FIGS. 27A–27F, nearby drive electrodes 197 are each connected to one of a first to a third electrode terminal 197*a*, 197*b* and 197*c*, thereby forming a first to a third drive electrode group. As voltages are applied to the electrode terminals 197*a*–197*c* from a power source unit, not shown the charge of the carrier of the developer and the charge of the stationary body 196*a* coact to generate a drive force due to the principle of electrostatic actuator transport. As a result, the developer (toner and carrier) is transported on and along the surface of the stationary body 196*a*. A plurality of drive electrodes are arranged in the lower actuator 195 in such a manner as to transport the developer from the rear side to the front side of the developing unit. The upper actuator 196, like the conventional fins 192, is inclined an angle $\theta$ toward the rear end of the developing unit so as to transport the developer while guiding it toward the rear, as shown in FIG. 26C. To desirably agitate the developer in the transverse direction, the angle $\theta$ is selected in consideration of the transport speed of the lower actuator 195 and the transport speed of the upper actuator 196 itself.

Referring to FIGS. 27A–27F, how the electrostatic actuators 195 and 196 each transports the carrier (deposited on the toner, although not shown) will be described. Assume that the actuator transports the carrier to the right as viewed in the figures.

Figure 27A:
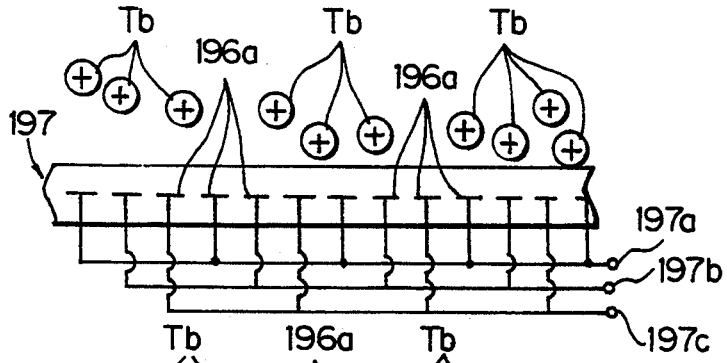
FIGS. 27A–27F are views representative of the principle of operation of the ninth embodiment.
Figure 27B:
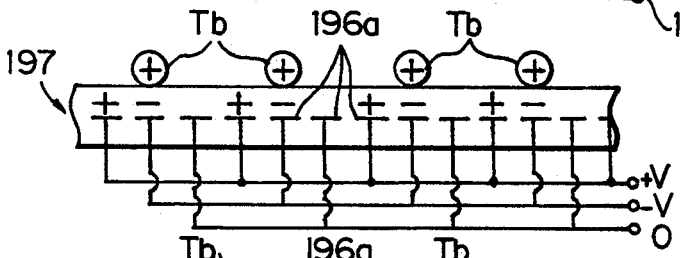

As shown in FIG. 27A, when no voltages are applied to the electrode terminals 197*a*–197*c*, charge does not exist on any of the drive electrodes 197. Although the carrier is frictionally charged to positive polarity by the friction thereof with the toner, it is not effected by the drive electrodes 197 at all and, therefore, not transported since the stationary body 196*a* is not charged. In this condition, the carrier floats around the developing roller 161 or deposits on the stationary body 196*a* due to some unexpected force which may act thereon. As shown in FIG. 27B, a positive voltage, a negative voltage and 0 V are applied to the first, second and third electrode terminals 197*a*, 197*b* and 197*c*, respectively. Then, the carrier is attracted by the drive electrodes 197 to which the voltage opposite in polarity to the carrier is applied, i.e., the positively charged carrier is caused to deposit on part of the surface of the stationary body 196*a* where the drive electrodes 197 applied with $-V$ are positioned. Meanwhile, the carrier is not attracted by the drive electrodes 197 to which $+V$ is applied or by the drive electrodes 197 to which no voltage is applied.

Figure 27C:
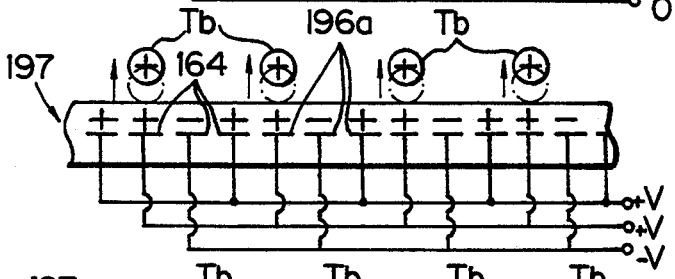

Subsequently, as shown in FIG. 27C, +V which is of the same polarity as the carrier is applied to the second group of drive electrodes 197 just underlying the carrier. At the same time, −V opposite in polarity to the carrier is applied to the third group of drive electrodes 197 next to the second group of drive electrodes 197 in the carrier transport direction (at the right-hand side in the embodiment). Further, +V is applied to the first group of drive electrodes 197 located at the left-hand side of the second group of drive electrodes 197. As a result, a repulsion acts between the carrier and the drive electrodes 197 underlying the carrier and of the same polarity as the carrier, causing the carrier to float. The drive electrodes 197 constituting the third electrode group attract the carrier floating at the upper left side thereof since the former is opposite in polarity to the latter. Further, the drive electrodes 197 constituting the first electrode group repulse the carrier floating at the upper right side thereof since the former is the same in polarity as the latter. As a result, a drive force acts on the carrier rightward and causes it to move about one pitch of the drive electrodes 197. At this instance, the friction between the carrier and the surface of the stationary body 196*a* is reduced by the force causing the toner to float.

Figure 27D:
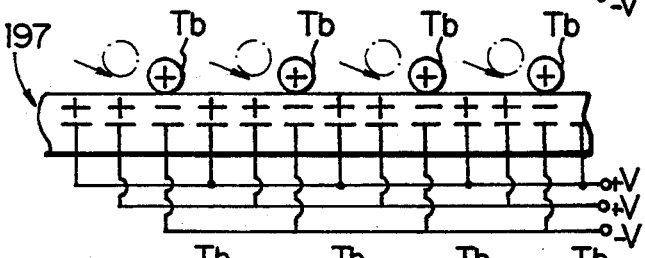
Figure 27E:
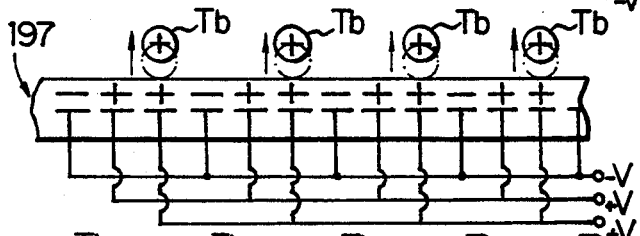
Figure 27F:
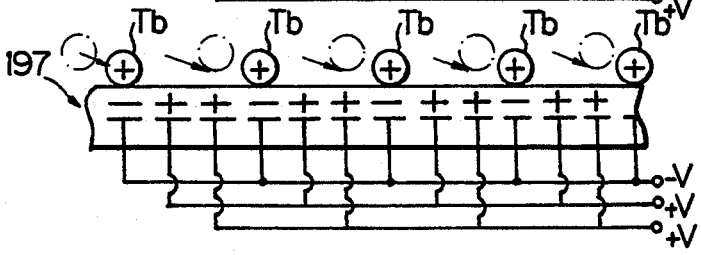

Thereupon, as shown in FIGS. 27E and 27F, the voltages applied to the drive electrodes 197 are switched over to shift such a repulsion and drive pattern acting on the carrier. By the above procedure, the carrier is transported along the actuator, about one pitch at a time.

The procedure shown in FIGS. 27B–27F and the subsequent switchover of the voltages to the drive electrode groups are listed in Table 5 below.

TABLE 5

| ELECTRODE GROUP | I | → | II | → | III | → | IV | → | ONWARD |
|---|---|---|---|---|---|---|---|---|---|
| 1ST GROUP | +V | → | +V | → | −V | → | +V | → | REPEAT II~IV |
| 2ND GROUP | −V | → | +V | → | +V | → | −V | → | REPEAT II~IV |
| 3RD GROUP | O | → | −V | → | +V | → | +V | → | REPEAT II~IV |

In Table 5, a step I corresponds to FIG. 27B, a step II corresponds to FIGS. 27C and 27D, and a step III corresponds to FIGS. 27E and 27F. In a step IV, +V, −V and +V are respectively applied to the first to third electrode groups to shift the repulsion and drive pattern acting on the carrier one pitch to the right in the carrier transport direction. Thereafter, the steps II–IV are repeated to shift such a pattern, one pitch at a time.

It is to be noted that in FIG. 27C (step II), for example, the positive voltage and the negative voltage may be respectively applied to the third group of drive electrodes and the first group of drive electrodes to reverse the drive direction.

In the above construction, the developer regulated or removed by the doctor blade 183 reaches the upper actuator 196. The developer at the rear side is let fall onto the lower actuator 195 via the inlet 191*a*, as indicated by an arrow A. Then, the lower actuator 195 conveys the developer from the rear to the front until the developer drops from the actuator 195 onto the paddle 174 via a developer outlet remote from the inlet 191*a*. The developer not fallen into the opening 191*a* is obliquely transported by the upper actuator 196 from the front side to the rear side, as indicated by an arrow B. This part of the developer also drops onto the paddle 174.

The upper and lower actuators 196 and 195 can be electrically controllably driven on the basis of the voltage or frequency to be applied to the drive electrodes 197. Therefore, various kinds of drive control are available with this embodiment, as will be described specifically hereinafter.

Assume that the toner concentration of the developer becomes irregular in the transverse direction in the developing unit by accident. This would directly translate into an irregular density distribution in the transverse direction of an image. A specific procedure for detecting the above occurrence and correcting the irregularity in the transverse direction is as follows.

Means for detecting irregularities in image density in the transverse direction are implemented by, for example, a plurality of (three in this case) reflection type photosensors arranged at spaced locations along the axis of the drum. These photosensors, i.e., front, center and rear photosensors face part of the surface of the drum 1 between a developing position and an image transfer position. The developing unit 16 develops a particular latent image or pattern extending in the axial direction of the drum 1 and formed by uniformly charging the drum 1. The photosensors sense the resulting toner image to locate a portion where the image density is lower than predetermined one. Then, a portion of the developing unit corresponding to the portion where the image density is low is determined to be short of toner. As a result, to increase the toner concentration of the portion of interest, a toner is supplemented, and at the same time the transport speed is so changed as to concentrate the supplementary toner at the above-mentioned portion.

Figure 28A:
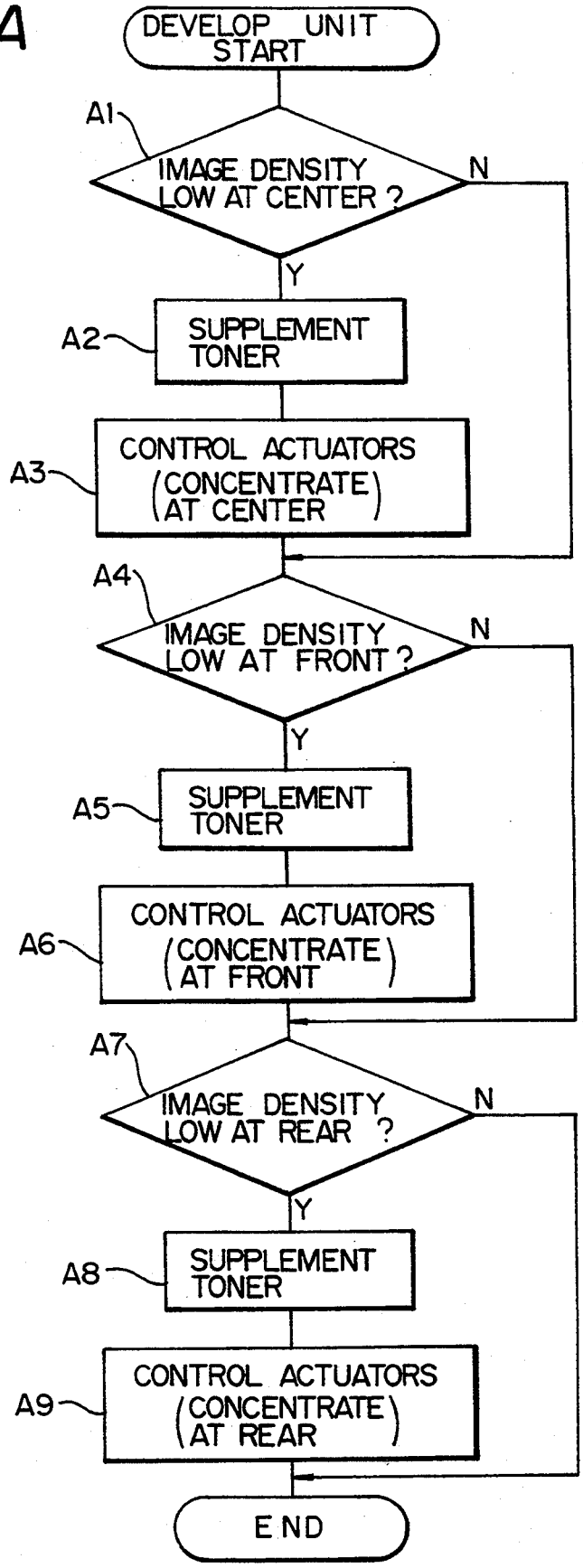
FIG. 28A is a flowchart demonstrating a specific operation of the ninth embodiment.

FIG. 28A is a flowchart demonstrating the above specific procedure. As shown, in steps A1–A3, when the outputs of the photosensors indicate that the image density is lowered at the center in the transverse direction, a toner is supplemented from the toner hopper 150 to the developing unit 16. Then, the actuators 195 and 196 transport the developer of high toner concentration in a greater amount to the center, thereby providing an image with uniform density. When the image density is lowered at the front side in the transverse direction, steps A4–A6 will be executed. Further, when the image density is lowered at the rear side, steps A7–A9 will be executed.

Figure 28B:
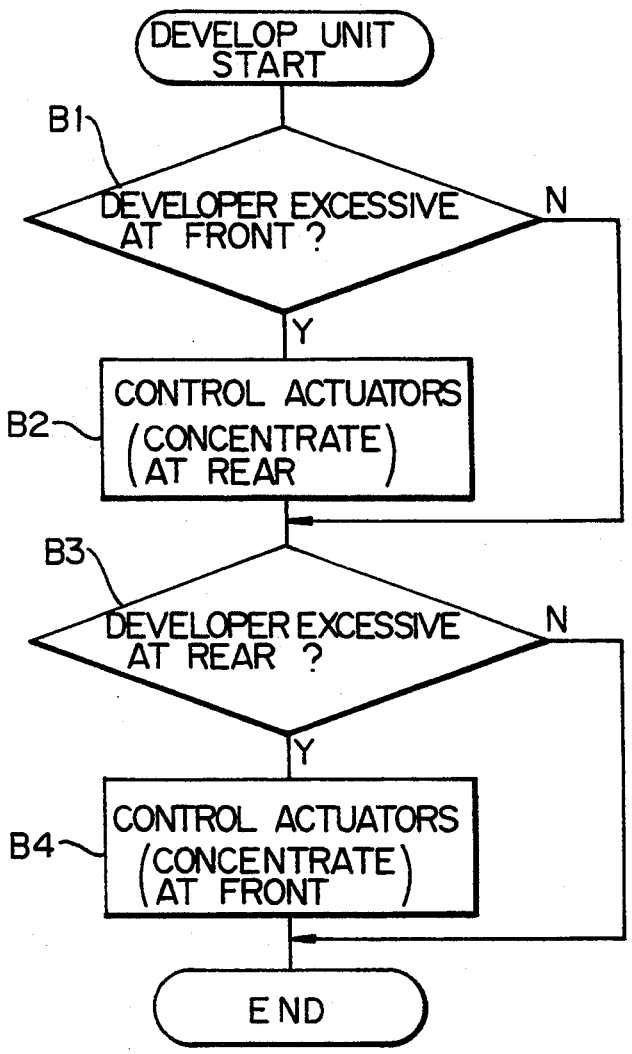
FIG. 28B is a flowchart representative of another specific operation of the ninth embodiment.

Also, the irregular distribution of the developer within the developing unit 16 can be corrected if the toner transport speed is controlled in response to the output of, for example, a magnetic sensor. FIG. 28B shows a specific procedure for executing this kind of control. As shown, the actuators 195 and 196 are so controlled as to concentrate the developer at the side opposite to the side where the amount of developer is excessive.

When the developer in the developing unit 16 is deteriorated due to repetitive use, it is replaced by, for example, a serviceman. At this instant, the serviceman has to remove the used developer to the outside of the developing unit. In this embodiment, since the recirculation of the developer in the developing unit is effected by two independent lines, i.e., the paddle 174 and other rotary members driven by a motor and the electrostatic actuators 195 and 196, it is necessary for the serviceman to operate the two different lines by hand. In the light of this, a mode for forcibly driving the actuators 195 and 196 in response to the operation of a key by the serviceman may be provided. Then, the developer existing on the actuators 195 and 196 can be fully let fall onto the paddle 174. All that is required of the serviceman i s to remove the developer by operating the paddle 174 and other rotary members by hand.

Assume that the casing above part of a developer transport path defined in the developing unit is provided with a door, and that the paddle 174 is forcibly driven by a switch similar to the above-mentioned implementation so as to automatically collect the developer in a container disposed below the door. Then, when the forcible drive switch is turned on, the actuators 195 and 195 may be driven together with the paddle 174.

In summary, it will be seen that the present invention provides a developing unit capable of transporting a developer in a transverse direction while agitating it and, therefore, practicable with a minimum number of parts, simple configuration, and low cost. The agitation in the transverse direction does not need a rotary drive system particular to a conventional screw type conveyor. This reduces the torque required of a drive mechanism and, therefore, further reduces the cost. Irregularity in image density in the transverse direction and in developer distribution within the developing unit can be automatically corrected. Moreover, a used developer can be easily removed from the developing unit since a developer existing on electrostatic actuators are fully removed only if a particular key is turned on.

Various modifications will become possible for those skilled in the art after receiving the teachings of the present disclosure without departing from the scope thereof.

What is claimed is:

1. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit, comprising a stationary roller-like body made of an insulating material, and a plurality of drive electrodes buried in said body, wherein nearby ones of said drive electrodes are each connected to a respective one of a first to a third electrode terminal thereby to form a first to a third drive electrode group and voltages whose polarities change in a predetermined pattern are applied from said first to said third electrode terminals, and wherein the voltage applied to the drive electrode group located at a developing region where the image carrier and the developer carrier face each other is higher than the voltage applied to the drive electrode group located in a transport region over which the developer supplied by said developer supplying means reaches said developing region.

2. A developing unit as claimed in claim 1, wherein an alternating voltage is superposed on the voltage to be applied to said drive electrode group located at the developing region.

3. A developing unit as claimed in claim 1, further comprising transport speed control means for controlling a speed at which the developer is transported on the developer carrier.

4. A developing unit as claimed in claim 3, wherein said transport speed control means comprises voltage control means for changing a frequency of the voltages to be applied to said electrostatic actuator means.

5. A developing unit incorporated in an image forming apparatus for developing an electrostatic latent image formed on an image carrier by supplying a developer from a developer carrier, comprising:

developer supplying means for supplying the developer to the developer carrier;

electrostatic actuator means serving as developer transporting means for transporting the developer supplied by said developer supplying means in a predetermined direction in said developing unit, comprising a stationary roller-like body made of an insulating material, and a plurality of drive electrodes buried in said body; and developer supply control means for controlling an amount of the developer to be supplied to the image carrier by said electrostatic actuator means;

wherein said developer supply control means comprises voltage control means for changing an amplitude of the voltages to be applied to said electrostatic actuator means.

6. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit, comprising a stationary roller-like body made of an insulating material, and a plurality of drive electrodes buried in said body;

wherein the developer comprises a toner, said drive electrodes being arranged in said developing unit in the predetermined direction at a pitch substantially equal to one-third of a particle size of the toner.

7. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit, comprising a stationary roller-like body made of an insulating material, and a plurality of drive electrodes buried in said body;

wherein the developer comprises two kinds of toners each being chargeable to a particular polarity.

8. A developing unit as claimed in claim 7, wherein the two kinds of toners are different in color.

9. A developing unit as claimed in claim 7, wherein the two kinds of toners are identical in color.

10. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit, comprising a stationary roller-like body made of an insulating material, and a plurality of drive electrodes buried in said body;

wherein said developer supplying means comprises a charging roller disposed below said roller-like stationary body of said electrostatic actuator means for charging the developer by friction.

11. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit, comprising a roller-like stationary body made of an insulating material, a plurality of drive electrodes buried in said roller-like stationary body, and a sleeve rotatably coupled over said roller-like stationary body and having a predetermined charge.

12. A developing unit as claimed in claim 11, wherein said sleeve comprises an insulating layer, and a conductive layer provided on said insulating layer.

13. A developing unit as claimed in claim 12, wherein said sleeve further comprises a dielectric layer provided on said conductive layer.

14. A developing unit as claimed in claim 11, wherein the developer comprises a magnetic toner, said sleeve being magnetized.

15. A developing unit incorporated in an image forming apparatus for developing an electrostatic latent image formed on an image carrier by supplying a developer from a developer carrier, comprising:

developer supplying means for supplying the developer to the developer carrier;

electrostatic actuator means serving as developer transporting means for transporting the developer supplied by said developer supplying means in a predetermined direction in said developing unit;

regulating means movable between an operative position contacting the developer carrier and an inoperative position spaced apart from said developer carrier for regulating a thickness of the developer to form a thin developer layer on said developer carrier;

driving means for selectively moving said regulating means to said operative position or to said inoperative position;

switching means for selectively switching a direction of transport of the developer on the developer carrier to a positive direction during development or to a reverse direction opposite to said positive direction; and control means for causing, after development, the developer on the developer carrier to move in said reverse direction for a predetermined period of time in a condition wherein said regulating means has been moved to said inoperative position and the direction of transport has been switched to said reverse direction.

16. A developing unit as claimed in claim 15, wherein said regulating means in said inoperative position is spaced apart from the developer carrier a distance greater than a thickness of the developer to be transported in said reverse direction.

17. A developing unit as claimed in claim 15, wherein said regulating means makes face-to-face contact with the developer carrier at said operative position.

18. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit, comprising a first electrostatic actuator located at a center of the developer carrier in the direction of transport of the developer, and a second electrostatic actuator located at opposite ends of the developer carrier to extend in a direction perpendicular to the direction of transport of the developer for returning the developer accidentally brought to said opposite ends of said developer carrier during transport.

19. A developing unit as claimed in claim 18, further comprising control means for controlling said first and second electrostatic actuators independently.

20. A developing unit as claimed in claim 19, further comprising sensing means for sensing the developer accidentally brought to the opposite ends of the developer carrier, said control means controlling said second electrostatic actuator in response to an output of said sensing means.

21. A developing unit incorporated in an image forming apparatus for developing an electrostatic latent image formed on an image carrier by supplying a developer from a developer carrier, comprising:

developer supplying means for supplying the developer to the developer carrier; and electrostatic actuator means serving as developer transporting means for transporting the developer supplied by said developer supplying means in a predetermined direction in said developing unit; and separator means having a hollow for returning the developer removed from the developer carrier to said developer supplying means.

22. A developing unit as claimed in claim 21, wherein said electrostatic actuator means comprises:

a lower electrostatic actuator disposed in said hollow of said separator means in a horizontal position; and an upper electrostatic actuator forming a horizontal top of said electrostatic actuator means for causing the developer removed from the developer carrier to slide.

23. A developing unit as claimed in claim 22, wherein said upper and lower electrostatic actuators each comprises:

a stationary body made of an insulating material; and a plurality of drive electrodes buried in said stationary body.

24. A developing unit as claimed in claim 23, wherein nearby ones of said plurality of drive electrodes are each connected to respective one of a first to a third electrode terminal to thereby form a first to a third drive electrode group.

25. A developing unit as claimed in claim 24, wherein voltages whose polarities change in a predetermined pattern are applied from said first to said third electrode terminal.

* * * * *